US011144007B2

(12) United States Patent
Hagiwara et al.

(10) Patent No.: US 11,144,007 B2
(45) Date of Patent: Oct. 12, 2021

(54) PROCESS CARTRIDGE AND IMAGE FORMING APPARATUS

(71) Applicant: CANON KABUSHIKI KAISHA, Tokyo (JP)

(72) Inventors: Shinichi Hagiwara, Tokyo (JP); Yasukazu Ikami, Tokyo (JP); Kosuke Ikada, Machida (JP); Keitaro Nakata, Suntou-gun (JP); Hideharu Shimozawa, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/681,100

(22) Filed: Nov. 12, 2019

(65) Prior Publication Data

US 2020/0150584 A1 May 14, 2020

(30) Foreign Application Priority Data

Nov. 14, 2018 (JP) ..... JP2018-213917
Dec. 28, 2018 (JP) ..... JP2018-247010

(51) Int. Cl.
*G03G 21/18* (2006.01)
*G03G 21/00* (2006.01)
(Continued)

(52) U.S. Cl.
CPC ..... *G03G 21/1814* (2013.01); *G03G 5/04* (2013.01); *G03G 5/06* (2013.01); *G03G 9/09725* (2013.01);
(Continued)

(58) Field of Classification Search
CPC ..... G03G 5/04; G03G 5/06; G03G 21/0029; G03G 21/1814; G03G 15/751; G03G 9/09725; G03G 9/09733; G03G 9/09791
See application file for complete search history.

(56) References Cited

U.S. PATENT DOCUMENTS 7,186,489 B2 3/2007 Uematsu
9,778,583 B2 10/2017 Terauchi
(Continued)

FOREIGN PATENT DOCUMENTS

EP 1584989 A2 10/2005
JP 2000047545 A 2/2000
(Continued)

OTHER PUBLICATIONS

Extended European Search Report issued in European Application No. 19208404.4 dated Mar. 13, 2020.

*Primary Examiner* — Ryan D Walsh
(74) *Attorney, Agent, or Firm* — Rossi, Kimms & McDowell LLP

(57) ABSTRACT

A process cartridge using an image forming apparatus, including a rotatable image bearing member having a circumferential surface; a developing unit configured to supply a developing agent to the image bearing member; and a cleaning member that cleans the circumferential surface, wherein the developing agent contains a toner including toner particles and a metal soap, the image bearing member includes a plurality of grooves formed on the circumferential surface to extend in a circumferential direction of the circumferential surface and to be arranged side by side in a rotation axis direction, and the plurality of grooves and portions between the grooves form concave-convex portions on the circumferential surface. The circumferential surface of the image bearing member had surface roughness Rz of $0<Rz\leq0.70$ μm and average interval Sm between concave-convex portions on the circumferential surface of $0<Sm\leq70.0$ μm.

17 Claims, 11 Drawing Sheets

(51) Int. Cl.

| | |
|---|---|
| ***G03G 9/097*** | (2006.01) |
| ***G03G 15/00*** | (2006.01) |
| ***G03G 5/04*** | (2006.01) |
| ***G03G 5/06*** | (2006.01) |

(52) U.S. Cl.
CPC ..... *G03G 9/09733* (2013.01); *G03G 9/09791* (2013.01); *G03G 15/751* (2013.01); *G03G 21/0029* (2013.01)

(56) References Cited

U.S. PATENT DOCUMENTS

2010/0119260 A1 5/2010 Egawa
2010/0178073 A1* 7/2010 Kabata ..... G03G 15/751 399/111
2011/0287356 A1* 11/2011 Fukao ..... G03G 9/0825 430/108.7
2012/0008984 A1* 1/2012 Kami ..... G03G 5/14791 399/159
2014/0064810 A1* 3/2014 Iwamoto ..... G03G 21/0017 399/350
2015/0003872 A1* 1/2015 Taniguchi ..... G03G 9/09725 399/176
2017/0329246 A1* 11/2017 Yamawaki ..... G03G 9/0821

FOREIGN PATENT DOCUMENTS

JP 2005121833 A 5/2005
JP 2005173021 A 6/2005
JP 4027407 B2 12/2007
JP 2011145457 A 7/2011
JP 5061787 B2 10/2012
JP 5335323 B2 11/2013
JP 2016038591 A 3/2016
JP 2018087874 A 6/2018

* cited by examiner

θ = 100 DEGREES

A–A CROSS SECTION

PROCESS CARTRIDGE AND IMAGE FORMING APPARATUS

BACKGROUND OF THE INVENTION

Field of the Invention

The present invention relates to an electrophotographic image forming apparatus. Here, the electrophotographic image forming apparatus (hereinafter simply referred to as an "image forming apparatus") forms an image on a recording member (recording medium) using an electrophotographic image forming system. Examples of an image forming apparatus include a copier, a printer (a laser beam printer, an LED printer, etc.), a facsimile machine, a word processor, and a multifunctional machine thereof (multifunction printer).

Description of the Related Art

In the related art, regarding an electrophotographic photosensitive member (hereinafter simply referred to as a "photosensitive member") used in an electrophotographic image forming apparatus, an organic photosensitive member has been widely used because it has advantages such as low price and high productivity. In this configuration, a photosensitive layer (organic photosensitive layer) using an organic material as a photoconductive material (a charge generating substance and a charge transport substance) is provided on a support. Regarding an organic photosensitive member, a photosensitive member having a laminated type photosensitive layer is mainly used because it has advantages such as high sensitivity and a variety of material designs. In this configuration, a charge generation layer containing a charge generating substance such as a photoconductive dye and a photoconductive pigment and a charge transport layer containing a charge transport substance such as a photoconductive polymer and a photoconductive low-molecular-weight compound are laminated.

Since an electrical external force and/or a mechanical external force are directly applied to the surface of the photosensitive member during charging, exposing, developing, transferring, and cleaning, durability against these external forces is required for the photosensitive member. Specifically, durability against the occurrence of scratches and wear on the surface due to these external forces, that is, scratch resistance and wear resistance, are required.

Generally, the following technologies are known as a technology for improving scratch resistance and wear resistance on the surface of an organic photosensitive member:

A photosensitive member having a cured layer using a curable resin as a binder resin as a surface layer.

A photosensitive member having a charge transportable cured layer formed by curing and polymerizing a monomer having a carbon-carbon double bond and a charge transportable monomer having a carbon-carbon double bond with heat or light energy as a surface layer.

A photosensitive member having a charge transportable cured layer formed by curing and polymerizing a hole transportable compound having a chain polymerizable functional group in the same molecule with electron beam energy as a surface layer.

In addition, in recent years, along with increasing market need for higher speeds and longer lifespans of image forming apparatuses, a photosensitive member having higher scratch resistance and higher wear resistance has been required. In order to meet this requirement, a photosensitive member having a wear-resistant protective layer (over coat layer: OCL) on the surface layer of the photosensitive member has been developed, and a technology for increasing the mechanical strength of the surface layer has been established.

However, when wear of the photosensitive member is reduced, the surface of the photosensitive member is less likely to be refreshed, and blurring of an electrostatic latent image called "image smearing" is likely to occur particularly in a high humidity environment. The cause of the image smearing is thought to be follows. A discharge product such as ozone and $NO_x$ is generated mainly by a charging means and adheres to the surface of the photosensitive member. The surface of the photosensitive member has a low surface friction coefficient and is hard and is unlikely to be scraped off, and the discharge products adhered to the surface are unlikely to be removed. Then, the discharge products which adhere to the surface of the photosensitive member and which are unlikely to be removed absorb water in a high humidity environment and a charge retention ability of the surface of the photosensitive member is reduced, and blurring of the electrostatic latent image is caused.

Therefore, in particular, when the hardness of the photosensitive member is high, it becomes more difficult to remove the discharge products adhered to its surface, and image smearing tends to occur.

Regarding a method of preventing image defects due to the discharge products, for example, such as image smearing:

Japanese Patent Application Laid-open No. 2005-173021 proposes that a heater is disposed around a photosensitive member, and in order to reduce power consumption, it is determined whether the heater will perform an operation by detecting a load torque of a motor generated when the photosensitive member is driven to rotate.

In Japanese Patent Application Laid-open No. 2000-47545, a method in which abrasive particles for polishing the surface of the photosensitive member are added to a developing agent in the developing unit has been proposed. In this method, abrasive particles accumulate on the cleaning unit in contact with the photosensitive member from the developing unit via the photosensitive member, the surface of the photosensitive member is rubbed with abrasive particles, and thereby the discharge product is removed.

In addition, Japanese Patent Application Laid-open No. 2005-121833 proposes a method in which a metal soap is incorporated into a developing agent, and the metal soap is supplied from a developing agent carrying member to the surface of the photosensitive member. In this method, zinc stearate as a metal soap is supplied through a developing unit, covers the surface of the photosensitive member, and the image smearing is reduced while maintaining wear resistance.

Patent Literature 1: Japanese Patent Application Laid-open No. 2005-173021

Patent Literature 2: Japanese Patent Application Laid-open No. 2000-47545

Patent Literature 3: Japanese Patent Application Laid-open No. 2005-121833

SUMMARY OF THE INVENTION

However, when the heater is disposed around the photosensitive member as in Japanese Patent Application Laid-open No. 2005-173021, the size of the image forming apparatus increases and power consumption increases. In addition, downtime such as heating control occurs and usability decreases.

In addition, as in Japanese Patent Application Laid-open No. 2000-47545, when abrasive particles are supplied to the photosensitive member, the surface of the photosensitive member is polished together with the discharge products, and it is not possible to maintain high scratch resistance and high wear resistance necessary for increasing the lifespan.

In addition, as in Japanese Patent Application Laid-open No. 2005-121833, when the metal soap supplied from the developing agent covers the surface of the photosensitive member, it is possible to achieve both wear resistance and image smearing reduction. However, since the metal soap supplied from the developing unit onto the photosensitive member is scraped off by the cleaning unit, it is necessary to continue supply of the metal soap from the developing unit constantly. Therefore, image smearing may occur in conditions in which an amount of the metal soap supplied is insufficient such as an operation state in which the developing unit is separated from the photosensitive member and a state in which the amount of the metal soap in the developing agent decreases in the latter half of the lifespan of the development apparatus.

An object of the present invention is to provide a process cartridge that can reduce the occurrence of image smearing by maintaining a supplied amount of a metal soap on the surface of an image bearing member in a configuration in which durability of the image bearing member is improved.

The present invention provides a process cartridge for use in an image forming apparatus, comprising:

an image bearing member configured to be rotatable and have a circumferential surface on which a latent image is formed;

a developing unit configured to supply a developing agent to the image bearing member in order to develop the latent image on the image bearing member; and a cleaning member configured to contact the circumferential surface of the image bearing member and clean the circumferential surface, wherein the developing agent contains a toner including toner particles and a metal soap, the image bearing member includes a plurality of grooves formed on the circumferential surface so as to extend in a circumferential direction of the circumferential surface and to be arranged side by side in a rotation axis direction, the plurality of grooves and portions between the grooves forming concave-convex portions on the circumferential surface, and the circumferential surface of the image bearing member has a ten-point average surface roughness Rz of $0<Rz\leq 0.70$ μm and an average interval Sm between concave-convex portions on the circumferential surface of $0<Sm\leq 70.0$ μm.

The present invention provides an image forming apparatus, comprising:

a device body; and the process cartridge according to claim 1 which is detachable from the device body.

According to the present invention, it is possible to provide a process cartridge that can reduce the occurrence of image smearing according to a simple configuration and control while maintaining durability of an image bearing member.

Further features of the present invention will become apparent from the following description of exemplary embodiments with reference to the attached drawings.

DESCRIPTION OF THE EMBODIMENTS

In the present invention, the statement "at least AA and not more than BB" and "AA to BB" indicating a numerical range refers to a numerical range including the lower limit and the upper limit which are end points unless otherwise noted.

Embodiments or examples of the present invention will be exemplified in detail below with reference to the drawings. However, sizes, materials, shapes, relative positions and the like of components described in embodiments or examples may be appropriately changed depending on the configuration of a device to which the invention is applied and various conditions, and as long as there is no particularly specific description, there is no intention to limit the scope of the invention to the following description. Each of the embodiments of the present invention described below can be implemented solely or as a combination of a plurality of the embodiments or features thereof where necessary or where the combination of elements or features from individual embodiments in a single embodiment is beneficial.

Embodiment 1

In the present invention, regarding a method of achieving the object, the surface of an image bearing member (photosensitive member) is subjected to a roughening treatment so that microscopic unevennesses are formed on the surface of an image bearing member (photosensitive member), and a metal soap accumulates in the unevennesses so that an amount of the metal soap on the surface of the image bearing member (photosensitive member) is maintained and the occurrence of image smearing is reduced.

Overall Schematic Configuration of Image Forming Apparatus

Figure 1:
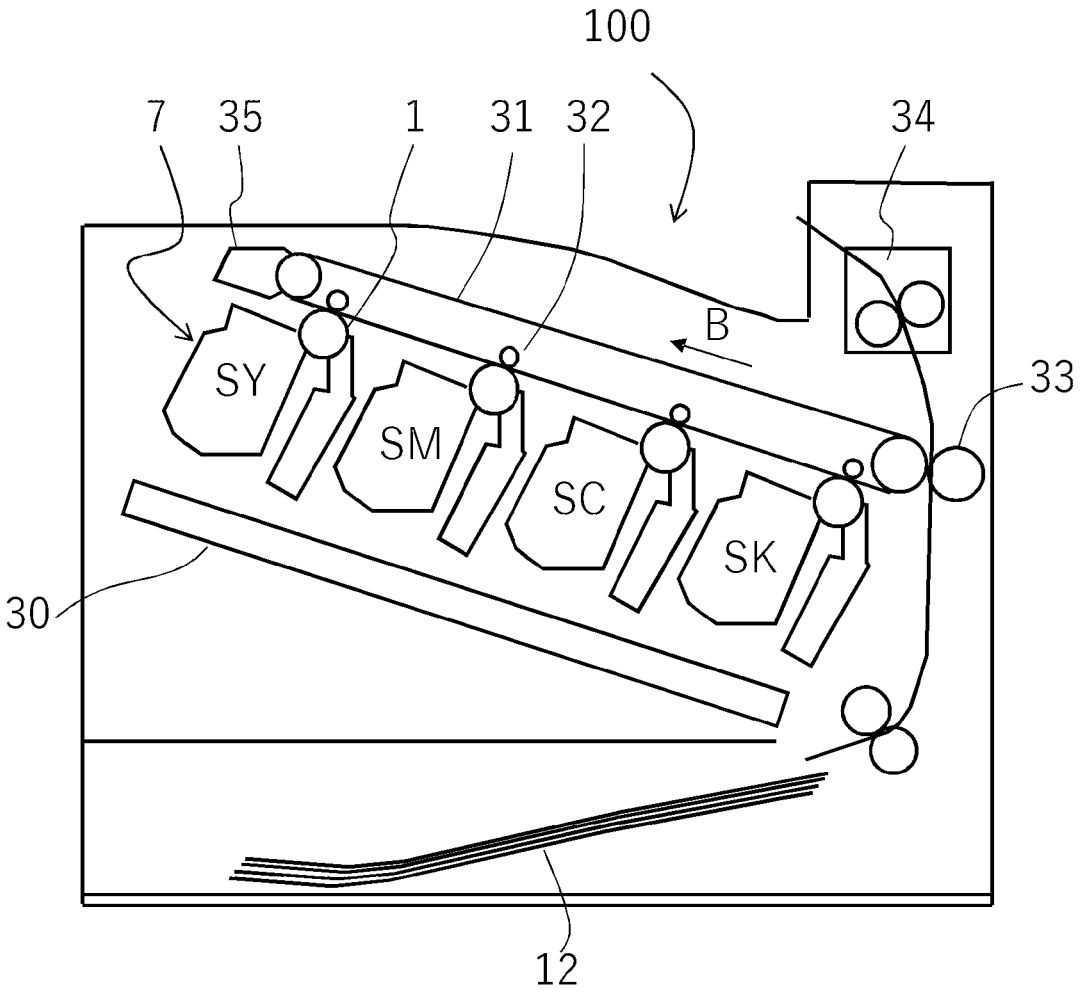
FIG. 1 is a schematic cross-sectional view of an image forming apparatus according to Embodiment 1 of the present invention.

An overall configuration of an electrophotographic image forming apparatus (image forming apparatus) according to an embodiment of the present invention will be described. FIG. 1 is a schematic cross-sectional view of an image forming apparatus 100 according to Embodiment 1 of the present invention. Examples of an image forming apparatus to which the present invention can be applied include a copier and a printer using an electrophotographic system, and a case in which the present invention is applied to a laser printer will be described here. The image forming apparatus 100 of Embodiment 1 is a full-color laser printer using an in-line system and an intermediate transfer system. The image forming apparatus 100 can form a full-color image on a recording member (for example, recording paper, plastic sheet, cloth, etc.) according to the image information. The image information is input to the image forming apparatus 100 from an image reading device (not shown) connected to the image forming apparatus 100 or a host device (not shown) such as a personal computer that is communicatively connected to the image forming apparatus 100.

The image forming apparatus 100 includes, as a plurality of image forming units, first, second, third, and fourth image forming units SY, SM, SC, and SK for forming images of respective colors of yellow (Y), magenta (M), cyan (C), and black (K). In the present embodiment, the first to fourth image forming units SY, SM, SC, and SK are disposed in a line in a direction intersecting the vertical direction.

Here, in the present embodiment, the configurations and operations of the first to fourth image forming units SY, SM, SC, and SK are substantially the same except that colors of images to be formed are different from each other. Therefore, unless there is a particular distinction below, subscripts Y, M, C, and K that are added to the reference numerals in order to indicate that they are elements provided for certain colors will be omitted and the units will be generally described.

In Embodiment 1, the image forming apparatus 100 includes, as a plurality of image bearing members, four drum type electrophotographic photosensitive members (hereinafter referred to as photosensitive members) 1 provided side by side in a direction intersecting the vertical direction. The photosensitive member 1 as an image bearing member that carries an electrostatic latent image (electrostatic image) is driven to rotate by a driving unit (not shown). A scanner unit (exposure device) 30 is disposed in the image forming apparatus 100. The scanner unit 30 is an exposure unit that emits a laser beam based on image information and forms an electrostatic latent image on the photosensitive member 1. In addition, in the image forming apparatus 100, an intermediate transfer belt 31 as an intermediate transfer member for transferring a toner image on the photosensitive member 1 to a recording member 12 is disposed so that it faces the four photosensitive members 1. The intermediate transfer belt 31 formed in an endless belt as the intermediate transfer member comes in contact with all of the photosensitive members 1, and circulates (rotates) in a direction indicated by the arrow B in the drawing (counterclockwise).

On the inner circumferential surface side of the intermediate transfer belt 31, four primary transfer rollers 32 as primary transfer units are provided so that they face the photosensitive members 1. Thus, a voltage having a polarity opposite to the normal charging polarity of the toner is applied to the primary transfer roller 32 from a primary transfer bias power supply as a primary transfer bias applying unit (not shown). Therefore, the toner image on the photosensitive member 1 is transferred (primary transfer) onto the intermediate transfer belt 31.

In addition, on the outer circumferential surface side of the intermediate transfer belt 31, a secondary transfer roller 33 as a secondary transfer unit is disposed. Thus, a voltage having a polarity opposite to the normal charging polarity of the toner is applied to the secondary transfer roller 33 from a secondary transfer bias power supply as a secondary transfer bias applying unit (not shown). Therefore, the toner image on the intermediate transfer belt 31 is transferred (secondary transfer) to the recording member 12. For example, when a full-color image is formed, the above processes are sequentially performed in the image forming units SY, SM, SC, and SK, and toner images of colors are superimposed and sequentially primary-transferred to the intermediate transfer belt 31. Then, the recording member 12 is conveyed to the secondary transfer unit in synchronization with movement of the intermediate transfer belt 31. Then, 4-color toner images on the intermediate transfer belt 31 are secondary-transferred onto the recording member 12 together due to the action of the secondary transfer roller 33 in contact with the intermediate transfer belt 31 via the recording member 12.

The toner that is not transferred to the recording member 12 by the secondary transfer roller 33 but remains on the intermediate transfer belt 31 is conveyed to a cleaning device 35 for an intermediate transfer member and removed.

The recording member 12 to which the toner image is transferred is conveyed to a fixing apparatus 34. The toner image is fixed to the recording member 12 by applying heat or a pressure to the recording member 12 in the fixing apparatus 34.

In the present embodiment, the photosensitive member 1, and a charging roller 2, a developing roller 4, a cleaning blade 8, and the like to be described below as processing units acting on the photosensitive member 1 are integrated, that is, formed into an integrated cartridge, to form a process cartridge 7.

Schematic Configuration of Process Cartridge

Figure 2:
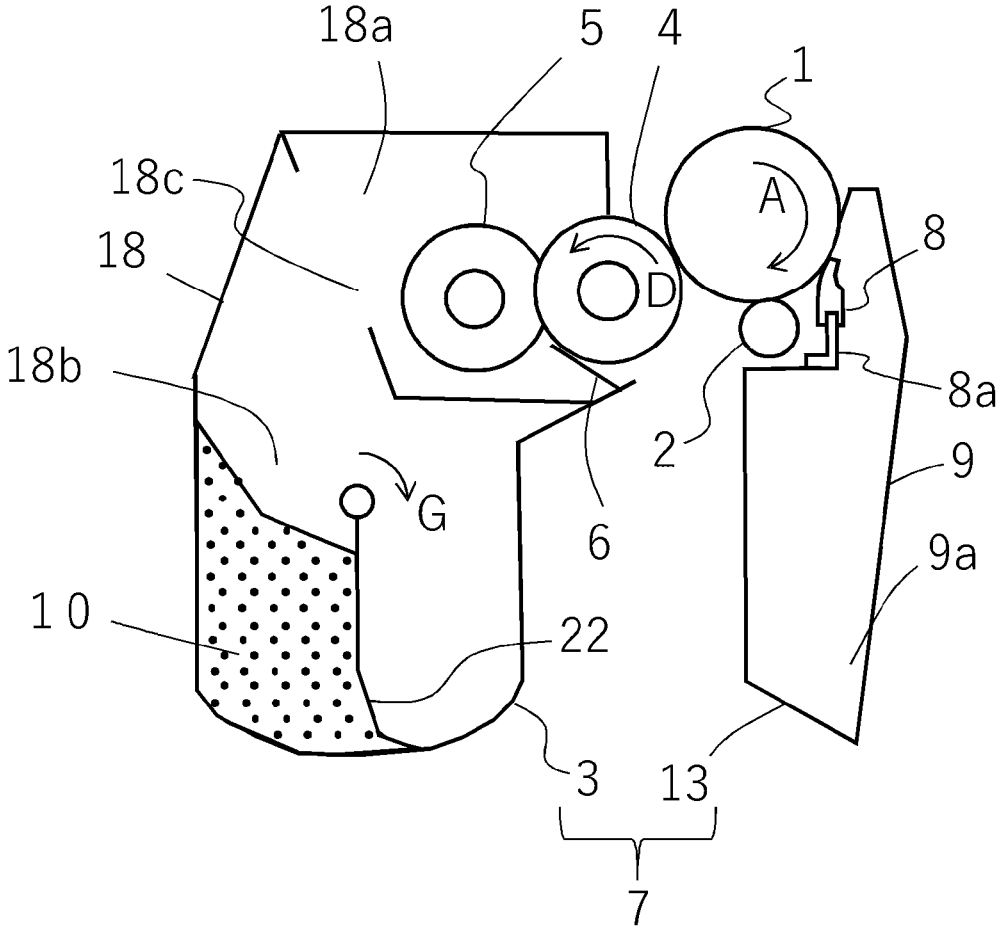
FIG. 2 is a schematic cross-sectional view of a process cartridge according to Embodiment 1 of the present invention.

An overall configuration of the process cartridge 7 mounted in the image forming apparatus 100 of Embodiment 1 will be described. FIG. 2 is a cross-sectional (main cross-sectional) view of the process cartridge 7 of Embodiment 1 when viewed in a longitudinal direction (rotation axis direction) of the photosensitive member 1. The process cartridge 7 is detachable from the image forming apparatus 100 via a mounting unit such as a mounting guide and a positioning member (not shown) provided in the image forming apparatus 100. In Embodiment 1, all of the process cartridges 7 for respective colors have the same shape, and toners 10 for yellow (Y), magenta (M), cyan (C), and black (K) colors are stored in the process cartridges 7 for respective colors. A case in which all of the process cartridges 7 are detachable from the image forming apparatus 100 has been described in Embodiment 1, but the present invention is not limited to such a configuration. For example, a configuration in which, in the process cartridges 7, a development apparatus 3 to be described below is independently detachable from the image forming apparatus 100 (separated from a photosensitive member unit 13 to be described below) may be used.

Here, in Embodiment 1, the configurations and operations of the process cartridges 7 for respective colors are substantially the same except for the type (color) of the toner 10 stored therein.

The process cartridge 7 includes the development apparatus 3 including the developing roller 4 and the like and the photosensitive member unit 13 including the photosensitive member 1.

The development apparatus 3 includes the developing roller 4, a toner supply roller 5, a toner transport member 22, and a developing frame body 18 that rotatably supports them. The developing frame body 18 includes a developing chamber 18*a* in which the developing roller 4 and the toner supply roller 5 are disposed and a toner storage chamber (developing agent storage chamber) 18*b* in which the toner 10 is stored. The developing chamber 18*a* and the toner storage chamber 18*b* communicate with each other through an opening 18*c*.

In the toner storage chamber 18*b*, the toner transport member 22 for conveying the toner 10 to the developing chamber 18*a* is provided, and the toner 10 is conveyed to the developing chamber 18*a* according to rotation in a direction indicated by the arrow G in the drawing.

In the developing chamber 18*a*, the developing roller 4 as a toner carrying member (developing agent carrying member) that is in contact with the photosensitive member 1 and rotates in a direction indicated by the arrow D in the drawing is provided. In Embodiment 1, the developing roller 4 and the photosensitive member 1 rotate so that surfaces at the facing portion (contact portion) move in the same direction, that is, rotation directions are opposite to each other.

In addition, a toner supply roller (hereinafter referred to as a "supply roller") 5 as a toner supply member that supplies the toner 10 conveyed from the toner storage chamber 18*b* to the developing roller 4 is disposed inside the developing chamber 18*a*. In addition, a toner amount control member 6 that regulates a coating amount of the toner 10 on the developing roller 4 supplied by the supply roller 5 and applies charging is disposed inside the developing chamber 18*a*.

Voltages are independently applied to the developing roller 4, the supply roller 5, and the toner amount control member (regulating member) 6 from a high pressure power supply (not shown). The toner 10 supplied to the developing roller 4 by the supply roller 5 is triboelectrically charged due to rubbing between the developing roller 4 and the regulating member 6, and the layer thickness is regulated at the same time as charging is applied. The regulated toner 10 on the developing roller 4 is conveyed to a portion facing the photosensitive member 1 according to rotation of the developing roller 4, and the electrostatic latent image on the photosensitive member 1 is developed and visualized as a toner image.

In Embodiment 1, when the electrostatic latent image on the photosensitive member 1 is developed and visualized as a toner image, the developing roller 4 that is in contact with the circumferential surface of the photosensitive member 1 is driven to rotate. That is, this is a contact development system in which a developing agent carrying member is brought into contact with the image bearing member in order to develop a latent image on the image bearing member using a developing agent. This is to facilitate supply of a metal soap externally added to the toner to be described below in detail of the toner onto the photosensitive member 1.

On the other hand, the photosensitive member unit 13 includes a cleaning frame body 9 as a frame body that supports various uses in the photosensitive member unit 13 of the photosensitive member 1 and the like. The photosensitive member 1 is rotatably adhered to the cleaning frame body 9 via a bearing (not shown). The photosensitive member 1 receives a driving force of a drive motor provided in a device main body of the image forming apparatus 100 and is driven to rotate in a direction indicated by the arrow A in the drawing.

In addition, in the photosensitive member unit 13, the charging roller 2, and the cleaning blade (cleaning member) 8 as a plate-like elastic body are disposed so that they come in contact with the circumferential surface of the photosensitive member 1. A voltage is applied to a metal core of the charging roller 2 from a high pressure power supply (not shown), and the surface of the photosensitive member 1 is charged to a predetermined voltage. The cleaning blade 8 of which one end is fixed to a metal sheet 8*a* as a plate-like support and of which the other end as a free end comes in contact with the photosensitive member 1 forms a contact region (hereinafter referred to as a "cleaning nip") with the photosensitive member 1.

The metal sheet 8*a* is fixed to the cleaning frame body 9. In the metal sheet 8*a*, one end is fixed to the cleaning frame body 9, and the cleaning blade 8 is fixed to the other end as a free end. In the metal sheet 8*a*, one plate part bent in an L-shape is fixed to the cleaning frame body 9 by a fastener such as a screw, and the other plate part extends in a direction substantially orthogonal to the one plate part, and the cleaning blade 8 is fixed to the tip (refer to FIG. 2). The metal sheet 8*a* (the other plate part) and the cleaning blade 8 extend together in substantially the same direction from the fixed end (one plate part) of the metal sheet 8*a*. The extending direction is a direction (reverse direction) opposite to the rotation direction of the photosensitive member 1 at a portion where the tip (the other end) of the cleaning blade 8 is in contact on the circumferential surface of the photosensitive member 1. The direction in which the metal sheet 8*a* and the cleaning blade 8 extend is a downward direction. The rotation direction of the photosensitive member 1 is a direction in which a portion where the tip (the other end) of the cleaning blade 8 is in contact on the circumferential surface of the photosensitive member 1 moves in a downward direction.

Here, an orientation of the process cartridge 7 in FIG. 2 is an orientation when it is mounted (used) in an image forming apparatus main body. In this specification, when the positional relationship and direction and the like of members of the process cartridge are described, the positional relationship and direction and the like in this orientation are shown. That is, in FIG. 2, the up to down direction in the drawing corresponds to the vertical direction, and the left to right direction in the drawing corresponds to the horizontal direction. Here, this disposition configuration is set on the assumption that the image forming apparatus is installed on a horizontal plane in a normal installation state.

When the cleaning blade 8 rubs against the circumferential surface of the photosensitive member 1, the occurrence of image problems caused when the toner 10 and fine particles remaining from the transfer step are scraped off from the photosensitive member 1, and the residual toner and the like contaminate the charging roller 2, and move around the photosensitive member 1 is prevented. The toner 10 removed from the photosensitive member 1 by the cleaning blade 8 falls into and is stored in a waste toner storage chamber 9*a* provided below the cleaning blade 8 in the cleaning frame body 9.

Details of Photosensitive Member

Figure 6A:
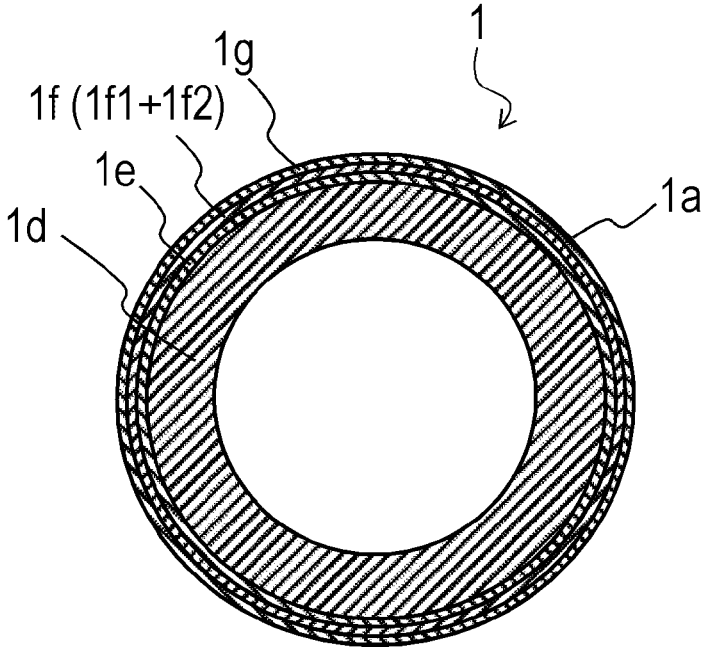
FIGS. 6A and 6B are schematic views showing a form example of a photosensitive member according to an embodiment of the present invention.

The photosensitive member (photosensitive drum) 1 in Embodiment 1 is produced according to a production method described in Japanese Patent No. 4027407. FIG. 6A is a schematic cross-sectional view of the photosensitive member 1 in Embodiment 1. As shown in FIG. 6A, the photosensitive member 1 includes a cylindrical metal support 1*d* having conductivity, an undercoat layer 1*e* formed on the support 1*d*, a photosensitive layer (a charge generation layer 1*f*1, a charge transport layer 1*f*2) 1*f* formed on the undercoat layer 1*e*, and a protective layer 1*g* formed on the photosensitive layer 1*f*. In addition, a surface 1*a* of the photosensitive member 1 (the protective layer 1*g*) is subjected to a roughening treatment by polishing. Further, a conductive layer (not shown) may be provided on the support 1*d* or on the undercoat layer 1*e*, or the undercoat layer 1*e* may be a conductive later.

Support

In Embodiment 1, the photosensitive member 1 includes the support 1*d*. In Embodiment 1, the support 1*d* is preferably a conductive support having conductivity. In addition, examples of the shape of the support 1*d* include a cylindrical shape, a belt shape, and a sheet shape. Among these, a cylindrical support is preferable. In addition, the surface of the support 1*d* may be subjected to an electrochemical treatment such as anodization, a blast treatment, a cutting treatment, or the like. Regarding the material of the support 1*d*, a metal, a resin or glass is preferable.

Examples of metals include aluminum, iron, nickel, copper, gold, stainless steel, and alloys thereof. Among these, an aluminum support using aluminum is preferable.

In addition, conductivity may be imparted to the resin or glass according to a treatment such as mixing in or applying conductive materials.

Conductive Layer

In addition, in Embodiment 1, a conductive layer may be provided on the support 1*d*. When the conductive layer is provided, it is possible to conceal scratches and unevennesses on the surface of the support 1*d* and control reflection of light on the surface of the support 1*d*. The conductive layer preferably includes conductive particles and a resin. Examples of materials of conductive particles include a metal oxide, a metal, and carbon black.

Examples of metal oxides include zinc oxide, aluminum oxide, indium oxide, silicon oxide, zirconium oxide, tin oxide, titanium oxide, magnesium oxide, antimony oxide, and bismuth oxide. Examples of metals include aluminum, nickel, iron, nichrome, copper, zinc, and silver. Among these, regarding conductive particles, a metal oxide is preferably used, and in particular, titanium oxide, tin oxide, or zinc oxide is more preferably used.

When a metal oxide is used as conductive particles, the surface of the metal oxide may be treated using a silane coupling agent, or an element such as phosphorus and aluminum or an oxide thereof may be doped into the metal oxide.

In addition, conductive particles may have a structure in which core material particles and a coat layer that covers the particles are laminated. Examples of core material particles include titanium oxide, barium sulfate, and zinc oxide. Examples of coat layers include layers of a metal oxide such as tin oxide.

In addition, when a metal oxide is used as conductive particles, the volume-average particle diameter is preferably at least 1 nm and not more than 500 nm and more preferably at least 3 nm and not more than 400 nm.

Examples of resins include a polyester resin, a polycarbonate resin, a polyvinyl acetal resin, an acrylic resin, a silicone resin, an epoxy resin, a melamine resin, a polyurethane resin, a phenolic resin, and an alkyd resin.

In addition, the conductive layer may further contain a masking agent such as silicone oil, resin particles, and titanium oxide.

The average film thickness of the conductive layer is preferably at least 1 μm and not more than 50 μm and particularly preferably at least 3 μm and not more than 40 μm.

The conductive layer can be formed by preparing a coating solution for a conductive layer containing the above materials and solvent, and forming the coating, and drying it. Examples of solvents used in the coating solution include an alcohol solvent, a sulfoxide solvent, a ketone solvent, an ether solvent, an ester solvent, and an aromatic hydrocarbon solvent. Examples of a dispersion method for dispersing conductive particles in the coating solution for a conductive layer include methods using a paint shaker, a sand mill, a ball mill, and a liquid collision type high-speed disperser.

Undercoat Layer

In Embodiment 1, the undercoat layer 1*e* is provided on the support 1*d* or the conductive layer. When the undercoat layer 1*e* is provided, an adhesive function between layers can be improved and a charge injection blocking function can be imparted.

The undercoat layer 1*e* preferably contains a resin. In addition, a composition containing a monomer having a polymerizable functional group may be polymerized to form an undercoat layer as a cured film.

Examples of resins include a polyester resin, a polycarbonate resin, a polyvinyl acetal resin, an acrylic resin, an epoxy resin, a melamine resin, a polyurethane resin, a phenolic resin, a polyvinyl phenolic resin, an alkyd resin, a polyvinyl alcohol resin, a polyethylene oxide resin, a polypropylene oxide resin, a polyamide resin, a polyamic acid resin, a polyimide resin, a polyamideimide resin, and a cellulose resin.

Examples of polymerizable functional groups that the monomer having a polymerizable functional group has include an isocyanate group, a block isocyanate group, a methylol group, an alkylated methylol group, an epoxy group, a metal alkoxide group, a hydroxyl group, an amino group, a carboxyl group, a thiol group, a carboxylic anhydride group, and a carbon-carbon double bond group.

In addition, the undercoat layer 1*e* may further contain an electron transport substance, a metal oxide, a metal, a conductive polymer or the like in order to improve electrical characteristics. Among these, an electron transport substance or a metal oxide is preferably used.

Examples of electron transport substances include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transport substance having a polymerizable functional group is used as an electron transport substance and is copolymerized with the above monomer having a polymerizable functional group and thereby an undercoat layer as a cured film may be formed.

Examples of metal oxides include indium tin oxide, tin oxide, indium oxide, titanium oxide, zinc oxide, aluminum oxide, and silicon dioxide. Examples of metals include gold, silver, and aluminum.

In addition, the undercoat layer 1*e* may further contain additives.

The average film thickness of the undercoat layer 1*e* is preferably at least 0.1 μm and not more than 50 μm, more preferably at least 0.2 μm and not more than 40 μm, and particularly preferably at least 0.3 μm and not more than 30 μm.

The undercoat layer 1*e* can be formed by preparing a coating solution for an undercoat layer containing the above materials and solvent and forming the coating, and drying and/or curing it. Examples of solvents used in the coating solution include an alcohol solvent, a ketone solvent, an ether solvent, an ester solvent, and an aromatic hydrocarbon solvent.

Charge Generation Layer

The charge generation layer 1*f*1 preferably contains a charge generating substance and a resin. Examples of charge generating substances include an azo pigment, a perylene pigment, a polycyclic quinone pigment, an indigo pigment, and a phthalocyanine pigment. Among these, an azo pigment or a phthalocyanine pigment is preferable. Among phthalocyanine pigments, an oxytitanium phthalocyanine pigment, a chlorogallium phthalocyanine pigment, or a hydroxygallium phthalocyanine pigment is preferable.

The content of the charge generating substance in the charge generation layer 1*f*1 is preferably at least 40 mass % and not more than 85 mass % and more preferably at least 60 mass % and not more than 80 mass % with respect to the total mass of the charge generation layer 1*f*1.

Examples of resins include a polyester resin, a polycarbonate resin, a polyvinyl acetal resin, a polyvinyl butyral resin, an acrylic resin, a silicone resin, an epoxy resin, a melamine resin, a polyurethane resin, a phenolic resin, a polyvinyl alcohol resin, a cellulose resin, a polystyrene resin, a polyvinyl acetate resin, and a polyvinyl chloride resin. Among these, a polyvinyl butyral resin is more preferable.

In addition, the charge generation layer 1*f*1 may further contain additives such as an antioxidant and a UV absorber. Specifically, a hindered phenolic compound, a hindered amine compound, a sulfur compound, a phosphorus compound, a benzophenone compound, and the like may be exemplified.

The average film thickness of the charge generation layer 1*f*1 is preferably at least 0.1 μm and not more than 1 μm and more preferably at least 0.15 μm and not more than 0.4 μm.

The charge generation layer 1*f*1 can be formed by preparing a coating solution for a charge generation layer containing the above materials and solvent, forming the coating, and drying it. Examples of solvents used in the coating solution include an alcohol solvent, a sulfoxide solvent, a ketone solvent, an ether solvent, an ester solvent, and an aromatic hydrocarbon solvent.

Charge Transport Layer

The charge transport layer 1*f*2 preferably contains a charge transport substance and a resin. Examples of charge transport substances include a polycyclic aromatic compound, a heterocyclic compound, a hydrazone compound, a styryl compound, an enamine compound, a benzidine compound, a triarylamine compound, and resins having groups derived from these substances. Among these, a triarylamine compound or a benzidine compound is preferable.

The content of the charge transport substance in the charge transport layer 1*f*2 is preferably at least 25 mass % and not more than 70 mass % and more preferably at least 30 mass % and not more than 55 mass % with respect to the total mass of the charge transport layer 1*f*2.

Examples of resins include a polyester resin, a polycarbonate resin, an acrylic resin, and a polystyrene resin. Among these, a polycarbonate resin and a polyester resin are preferable. Regarding the polyester resin, particularly, a polyarylate resin is preferable.

A content ratio (mass ratio) between the charge transport substance and the resin is preferably 4:10 to 20:10 and more preferably 5:10 to 12:10.

In addition, the charge transport layer 1*f*2 may contain additives such as an antioxidant, a UV absorber, a plasticizer, a leveling agent, a slip-imparting agent, and a wear resistance improving agent. Specifically, a hindered phenolic compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, boron nitride particles, and the like may be exemplified.

The average film thickness of the charge transport layer f2 is preferably at least 5 μm and not more than 50 μm, more preferably at least 8 μm and not more than 40 μm, and particularly preferably at least 10 μm and not more than 30 μm. In Embodiment 1, the average film thickness is 12 μm.

The charge transport layer 1*f*2 can be formed by preparing a coating solution for a charge transport layer containing the above materials and solvent, forming the coating, and drying it. Examples of solvents used in the coating solution include an alcohol solvent, a ketone solvent, an ether solvent, an ester solvent, and an aromatic hydrocarbon solvent. Among these solvents, an ether solvent or an aromatic hydrocarbon solvent is preferable.

Here, in Embodiment 1, a lamination type photosensitive member including the charge generation layer 1*f*1 and the charge transport layer 1*f*2 is used. However, a single layer type photosensitive member containing both a charge generating substance and a charge transport substance may be used. The single layer type photosensitive member can be formed by preparing a coating solution for a photosensitive layer containing a charge generating substance, a charge transport substance, a resin, and a solvent, forming the coating, and drying it. The charge generating substance, the charge transport substance, and the resin are the same as those exemplified for materials in the lamination type photosensitive member.

Protective Layer

In order to improve wear resistance, in the photosensitive member 1 in Embodiment 1, the wear-resistant protective layer 1*g* is provided on the outermost layer. When the protective layer 1*g* is provided, it is possible to improve durability.

The protective layer 1*g* preferably contains conductive particles and/or a charge transport substance, and a resin.

Examples of conductive particles include particles of a metal oxide such as titanium oxide, zinc oxide, tin oxide, and indium oxide.

Examples of charge transport substances include a polycyclic aromatic compound, a heterocyclic compound, a hydrazone compound, a styryl compound, an enamine compound, a benzidine compound, and a triarylamine compound, and a resin having a group derived from such substances. Among these, a triarylamine compound or a benzidine compound is preferable.

Examples of resins include a polyester resin, an acrylic resin, a phenoxy resin, a polycarbonate resin, a polystyrene resin, a phenolic resin, a melamine resin, and an epoxy resin. Among these, a polycarbonate resin, a polyester resin, and an acrylic resin are preferable.

In addition, the protective layer 1*g* may be formed as a cured film by polymerizing a composition containing a monomer having a polymerizable functional group.

Examples of reactions at that time include a thermal polymerization reaction, a photopolymerization reaction, and a radiation polymerization reaction. Examples of polymerizable functional groups that the monomer having a polymerizable functional group has include an acrylic group and a methacrylic group. Regarding the monomer having a polymerizable functional group, a material having a charge transport ability may be used.

The protective layer 1*g* may contain additives such as an antioxidant, a UV absorber, a plasticizer, a leveling agent, a slip-imparting agent, and a wear resistance improving agent. Specific examples thereof include a hindered phenolic compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average film thickness of the protective layer 1*g* is preferably at least 0.5 μm and not more than 10 μm and more preferably at least 1 μm and not more than 7 μm.

The protective layer 1*g* can be formed by preparing a coating solution for a protective layer containing the above materials and solvent, forming the coating, and drying and/or curing it. Examples of solvents used in the coating solution include an alcohol solvent, a ketone solvent, an ether solvent, a sulfoxide solvent, an ester solvent, and an aromatic hydrocarbon solvent.

In Embodiment 1, the average film thickness of the protective layer 1*g* is set to 3 μm.

Roughening Treatment

In order to maintain the effect of the metal soap, the photosensitive member 1 of Embodiment 1 is subjected to a roughening treatment for forming microscopic unevennesses on the surface. According to Japanese Patent No. 4027407, the photosensitive member 1 includes a plurality of grooves formed on the circumferential surface so as to extend substantially in a circumferential direction, to be arranged side by side in the longitudinal direction (busbar direction, a rotation axis direction of the photosensitive member 1), and to have a width within a range of at least 0.5 μm and not more than 40 μm.

Figure 6B:
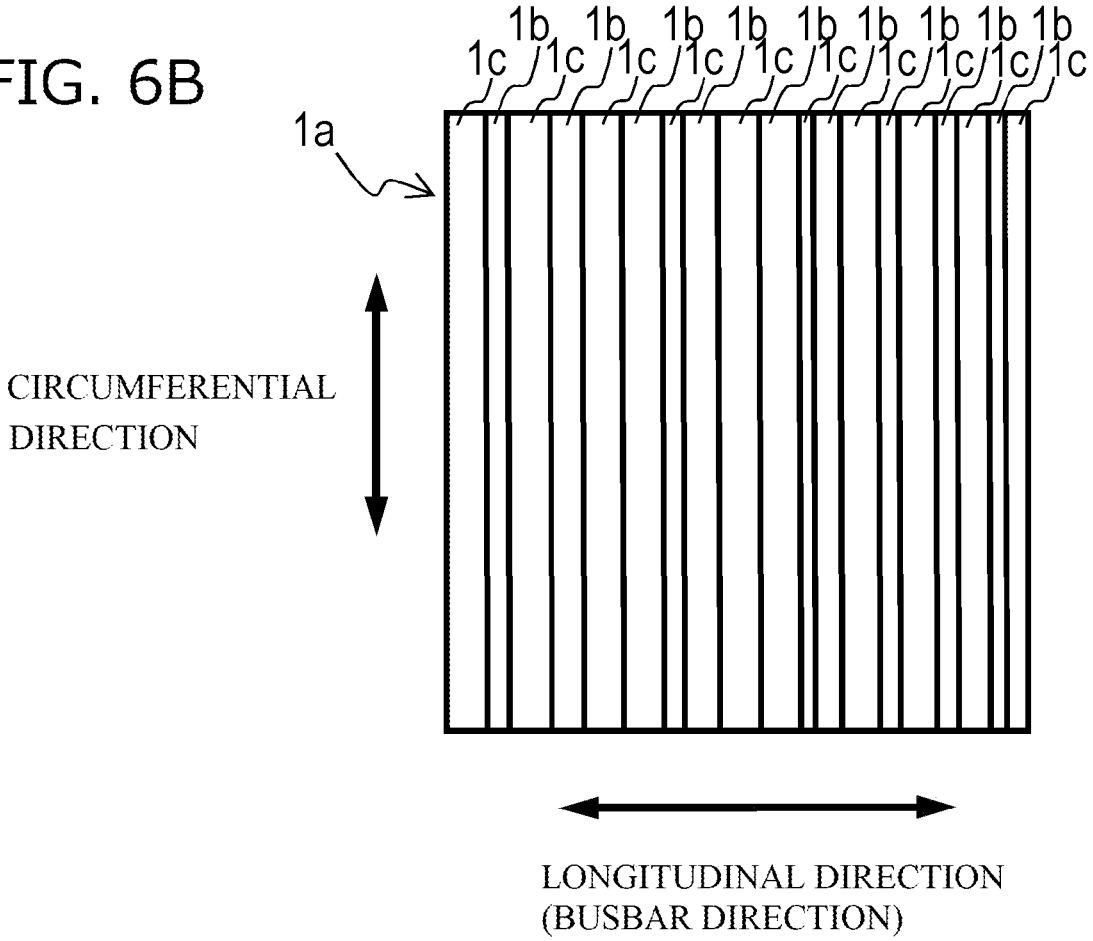

FIG. 6B shows an example of a state of a groove 1*b* formed on the circumferential surface 1*a* of the photosensitive member 1. As shown in FIG. 6B, the grooves 1*b* are annular grooves that extend in the circumferential direction on the circumferential surface 1*a* of the photosensitive member 1 and are arranged at intervals in the busbar direction of the circumferential surface 1*a*. That is, the circumferential surface 1*a* has a configuration in which flat parts 1*c* in which no grooves 1*b* are formed and the grooves 1*b* are alternately formed in the busbar direction. Here, a region in which the groove 1*b* is formed on the circumferential surface 1*a* need only include at least a region with which the cleaning blade 8 comes in contact, and is not necessary formed over the entire circumferential surface 1*a* in the longitudinal direction.

Here, as described in the above publication, the present invention is not limited to the configuration in which the grooves 1*b* are formed to extend in the same direction as in the circumferential direction as shown in FIG. 6B. For example, a configuration in which the grooves 1*b* are formed with an angle of 10° with respect to the circumferential direction may be used. In addition, a configuration in which the grooves 1*b* are formed with an angle of ±30° with respect to the circumferential direction may be used or a configuration in which the grooves 1*b* having different angles cross each other may be used. In the present embodiment, "substantially circumferential direction" includes a completely circumferential direction and a substantially circumferential direction, and the substantially circumferential direction specifically refers to a direction of less than ±60° with respect to the circumferential direction.

Figure 3:
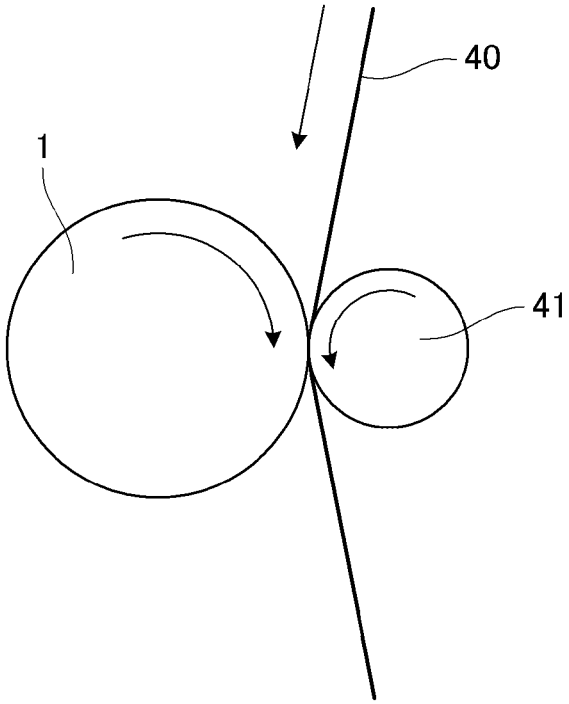
FIG. 3 is a schematic view of a polishing device for polishing the surface of a photosensitive member according to Embodiment 1 of the present invention.

FIG. 3 is a schematic view of a polishing device for polishing the surface of the photosensitive member 1.

A polishing sheet 40 is wound in a winding mechanism (not shown) in the arrow direction. The photosensitive member 1 rotates in the arrow direction. A backup roller 41 rotates in the arrow direction. Regarding polishing conditions, a polishing sheet (product name: GC #3000, base layer sheet thickness: 75 μm, commercially available from Riken Corundum Co., Ltd.) is used as the polishing sheet 40, a urethane roller (outer diameter: 50 mm) with a hardness of 20° is used as the backup roller 41, a penetration level is set to 2.5 mm, a sheet feed amount is set to 200 to 400 mm/s, the feed direction of the polishing sheet and the rotation direction of the photosensitive member are set to be the same, and polishing is performed for 5 to 30 seconds.

The surface roughness of the polished photosensitive member 1 is measured using a surface roughness measuring device (product name: SE700, SMB-9, commercially available from Kosaka Laboratory Ltd.) under the following conditions.

In the longitudinal direction of the photosensitive member 1, measurement is performed at positions of 30, 110, and 185 mm from the upper end of coating, and forward rotation of 120° is performed and in the same manner, measurement is then performed at positions of 30, 110, and 185 mm from the upper end of coating. In addition, rotation is performed forward 120° and in the same manner, measurement is then performed. The measurement is performed at a total of 9 points, and photosensitive members a to e in Table 1 are produced. Measurement conditions are as follows: measurement length: 2.5 mm, cut-off value: 0.8 mm, feeding speed: 0.1 mm/s, filter characteristics: 2CR, and leveling: straight line (the entire region).

The photosensitive members a to d are produced by changing the polishing time in the above roughening treatment conditions. In addition, a photosensitive member e is a photosensitive member that is not subjected to a roughening treatment.

TABLE 1

| | RZ (μm) | Sm (μm) |
|---|---|---|
| Photosensitive member a | 0.36 | 12.6 |
| Photosensitive member b | 0.44 | 8.6 |
| Photosensitive member c | 0.53 | 7.5 |
| Photosensitive member d | 0.92 | 25.9 |
| Photosensitive member e | 0.04 | 416.6 |

Where RZ (μm) is the ten-point average surface roughness and Sm (μm) the average interval between unevennesses.

Developing Agent

In the present invention, the developing agent includes a toner containing a toner particle and a metal soap. In addition, the developing agent of Embodiment 1 includes a toner containing a toner particle, inorganic silicon fine particles present on the surface of the toner particle, and a metal soap.

In the present invention, the toner particle may contain a binder resin as a constituent component.

Examples of binder resins include a polyester resin, a vinyl resin, an epoxy resin, and a polyurethane resin.

The polyester resin may be produced using a method of polycondensating an alcohol component and an acid component, which is generally known.

Vinyl resins may be produced by polymerizing polymerizable monomers such as styrene and derivatives thereof; unsaturated monoolefins; unsaturated polyenes; α-methylene aliphatic monocarboxylic acid esters; acrylic esters; vinyl ketones; acrylic acids such as acrylonitrile, methacrylonitrile, and acrylamide or methacrylic acid derivatives.

The toner particle may contain a release agent. The release agent is not limited as long as it can improve releasability, and examples thereof are as follows.

Aliphatic hydrocarbon waxes such as a polyolefin copolymer, a polyolefin wax, a microcrystalline wax, a paraffin wax, and a Fischer-Tropsch wax.

The content of the release agent is preferably at least 1.0 part by mass and not more than 30.0 parts by mass and more preferably at least 5.0 parts by mass and not more than 25.0 parts by mass with respect to 100.0 parts by mass of the binder resin or polymerizable monomers that produce the binder resin.

Regarding the toner, either a magnetic mono-component toner or a non-magnetic mono-component toner can be used as the toner. However, a non-magnetic mono-component toner is preferable.

Examples of colorants when used as a non-magnetic mono-component toner include conventionally known various dyes and pigments.

Examples of black colorants include carbon black and those that are toned to black using the following yellow, magenta, and cyan colorants.

Examples of yellow colorants include a monoazo compound, a disazo compound, a condensed azo compound, an isoindolinone compound, an anthraquinone compound, an azo metal complex, a methine compound, and an allylamide compound.

Examples of magenta colorants include a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Examples of cyan colorants include a copper phthalocyanine compound and derivatives thereof, an anthraquinone compound, and a basic dye lake compound.

The content of the colorant is preferably at least 1.0 part by mass and not more than 20.0 parts by mass with respect to 100.0 parts by mass of the binder resin or polymerizable monomers that produce the binder resin.

The toner particle may contain a charge control agent. Regarding the charge control agent, known agents can be used. In particular, a charge control agent that has a high charging speed and can stably maintain a certain charge amount is preferable. In addition, when a toner particle is produced by a direct polymerization method, a charge control agent having low polymerization inhibition and substantially free from a material solubilized in an aqueous medium is particularly preferable.

Examples of charge control agents that perform control such that a toner particle is negatively charged include the following agents.

Examples of organometallic compounds and chelate compounds include monoazo metal compounds, acetyl acetone metal compounds, and aromatic oxycarboxylic acid, aromatic dicarboxylic acid, oxycarboxylic acid and dicarboxylic acid metal compounds. Other examples include aromatic oxycarboxylic acids, aromatic mono and polycarboxylic acids and metal salts thereof, anhydrides or esters, and phenol derivatives such as bisphenol. In addition, urea derivatives, metal-containing salicylic acid compounds, metal-containing naphthoic acid compounds, boron compounds, quaternary ammonium salts, and calixarene may be exemplified.

On the other hand, examples of charge control agents that perform control such that a toner particle is positively charged include the following agents.

Nigrosine modified products such as nigrosine and fatty acid metal salts; guanidino compounds; imidazole compounds; quaternary ammonium salts such as tributylbenzylammonium-1-hydroxy-4-naphthosulfonate, and tetrabutylammonium tetrafluoroborate and onium salts such as phosphonium salts which are analogs thereof, and lake pigments thereof; triphenylmethane dyes and lake pigments thereof (as lake agents, phosphotungstic acid, phosphomolybdic acid, phosphotungstic molybdic acid, tannic acid, lauric acid, gallic acid, ferricyanide, ferrocyanide, etc.); higher fatty acid metal salts; and resin charge control agents.

These charge control agents can be contained alone or in a combination of two or more thereof. An amount of such a charge control agent added is preferably at least 0.01 parts by mass and not more than 10 parts by mass with respect to 100 parts by mass of the binder resin or polymerizable monomers that produce the binder resin.

Details of Toner

Figure 4:
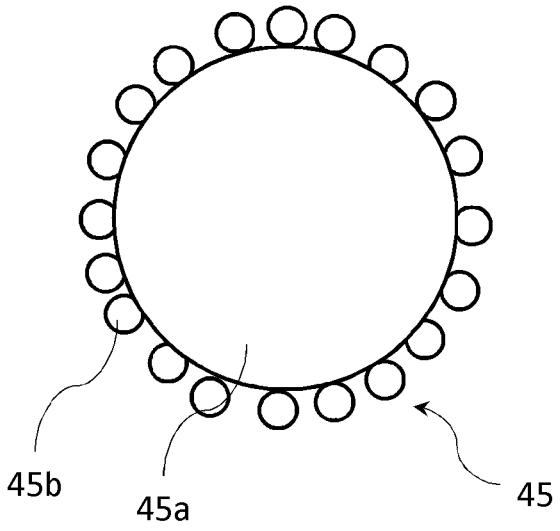
FIG. 4 is a schematic view of a toner according to Embodiment 1 of the present invention.

FIG. 4 shows a schematic view of the toner used in Embodiment 1. In Embodiment 1, a toner 45 in which inorganic silicon fine particles 45*b* are externally added to a toner particle 45*a* in order to secure flowability and improve charging performance is used.

The toner used in Embodiment 1 is a non-magnetic mono-component polymerization toner having negatively charged polarity and has a weight-average particle diameter of 7.0 μm.

In addition, in order to reduce image smearing, a metal soap (not shown) is externally added in addition to the inorganic silicon fine particles 45*b*. When the metal soap is supplied to a photosensitive member to form a protective film, it is possible to limit adhesion of a discharge product and the like, and it is possible to reduce image smearing of the photosensitive member 1.

Examples of inorganic silicon fine particles include silica fine particles such as wet silica fine particles and dry silica fine particles, and hydrophobized silica fine particles obtained by performing a surface treatment on such silica fine particles using a silane coupling agent, a titanium coupling agent, silicone oil or the like.

Dry silica fine particles are produced using, for example, a pyrolysis oxidation reaction of a silicon tetrachloride gas in an oxyhydrogen flame, and the basic reaction formula is as follows.

$$SiCl_4+2H_2+O_2 \rightarrow SiO_2+4HCl$$

In this producing step, other metal halogen compounds such as aluminum chloride or titanium chloride are used together with a silicon halogen compound, and thereby composite fine particles containing silica and other metal oxides can be obtained, and these are also included as inorganic silicon fine particles.

The number-average particle diameter (D1) of primary particles of the inorganic silicon fine particles is preferably 5 nm or more, 10 nm or more, 15 nm or more, 20 nm or more, or 25 nm or more and preferably 500 nm or less, 400 nm or less, 300 nm or less, 250 nm or less, or 200 nm or less. The numerical ranges can be arbitrarily combined.

The content of the inorganic silicon fine particles is preferably at least 0.1 parts by mass and not more than 10.0 parts by mass and more preferably at least 1.0 part by mass and not more than 5.0 parts by mass with respect to 100.0 parts by mass of the toner particle.

A metal soap is externally added to the toner of the present invention. When the metal soap is supplied to a photosensitive drum to form a protective film, it is possible to limit adhesion of a discharge product and the like, and it is possible to reduce image smearing of the photosensitive drum 1.

The metal soap is a generic name for long chain fatty acids and metal salts other than sodium/potassium. Specific examples thereof include metal salts of fatty acids such as stearic acid, myristic acid, lauric acid, ricinoleic acid, octylic acid, and metals such as lithium, magnesium, calcium, barium, and zinc.

More specific examples thereof include lead stearate, cadmium stearate, barium stearate, calcium stearate, aluminum stearate, zinc stearate, magnesium stearate, zinc laurate, and zinc myristate. Here, the type of metal soap is not limited thereto.

In the embodiment of the present invention, zinc stearate is externally added as the metal soap.

The content of the metal soap in the toner is preferably 0.60 mass % or less, 0.50 mass % or less, 0.40 mass % or less, or 0.30 mass % or less. On the other hand, the content is preferably 0.05 mass % or more, 0.10 mass % or more, 0.15 mass % or more, or 0.20 mass % or more. The numerical ranges can be arbitrarily combined.

When the content is larger, it is more effective in reducing image smearing, but if it is added excessively, flowability of the toner is lowered, which may influence a solid-image following ability.

The average particle diameter of the metal soap is preferably at least 0.15 μm and not more than 2.00 μm.

When the particle diameter is smaller than 0.15 μm, it is difficult to supply the metal soap from the toner to grooves on the surface of the photosensitive member. On the other hand, when the particle diameter is larger than 2.00 μm, the metal soap is easily released from the toner, and cannot pass through a toner regulating member or the like in a development apparatus, but remains in a developer container, and is difficult to supply to the surface of the photosensitive member.

The average particle diameter of the metal soap is measured by the following method.

10 mL of ethanol is added to 0.5 g of a metal soap and ultrasonic dispersion is performed using an ultrasonic disperser (commercially available from Nippon Seiki Co., Ltd.) for 5 minutes. Next, the obtained metal soap dispersion solution is added to a Microtrac laser diffraction and scattering type particle size distribution measuring device (SPA type, commercially available from Nikkiso Co., Ltd.) in which ethanol as a measurement solvent circulates so that the DV value reaches 00.6 to 0.8. Then, a particle size distribution in this state is measured, and the median diameter is defined as an average particle diameter.

In addition, the metal soap of the average particle diameter may be produced, for example, by a double decomposition method in which a fatty acid salt aqueous solution and an inorganic metal salt aqueous solution or dispersion solution are reacted.

In the embodiment of the present invention, zinc stearate particles having an average particle diameter of 0.60 μm are used. The average particle diameter of zinc stearate particles is preferably 0.15 to 2.00 μm.

The metal soap is charged with a polarity opposite to that of the toner and thus adheres to the toner particle, and is then supplied onto the photosensitive drum during non-image formation.

Regarding a method of producing a toner particle, known methods can be used, and a kneading pulverization method and a wet production method can be used. In consideration of particle diameter uniformity and shape controllability, the wet production method can be preferably used. In addition, examples of wet production methods include a suspension polymerization method, a dissolution suspension method, an emulsion polymerization aggregation method, and an emulsion aggregation method.

Here, the suspension polymerization method will be described. In the suspension polymerization method, first, polymerizable monomers for producing a binder resin, and as necessary, other additives such as a colorant are uniformly dissolved or dispersed using a disperser such as a ball mill and an ultrasonic disperser to prepare a polymerizable monomer composition (step of preparing a polymerizable monomer composition). In this case, as necessary, a multifunctional monomer, a chain transfer agent, a wax as a release agent, a charge control agent, a plasticizer and the like can be appropriately added.

Next, the polymerizable monomer composition is added to an aqueous medium prepared in advance, and droplets made of the polymerizable monomer composition are formed into a toner particle with a desired size using a stirrer or disperser having a high shear force (granulating step).

It is preferable that the aqueous medium in the granulating step contain a dispersion stabilizer in order to control the particle diameter of the toner particle, sharpen the particle size distribution, and reduce aggregation of toner particles in the production procedure.

Dispersion stabilizers are generally broadly classified into polymers that exhibit a repulsive force due to steric hindrance and inorganic compounds with low water solubility that stabilize dispersion with an electrostatic repulsive force. Inorganic compound fine particles with low water solubility are suitably used because they are dissolved in an acid or alkali and thus they can be dissolved and easily removed by washing with an acid or alkali after polymerization.

After the granulating step or while performing the granulating step, the temperature is preferably set to at least 50° C. and not more than 90° C., polymerizable monomers included in the polymerizable monomer composition are polymerized to obtain a toner particle dispersion solution (polymerizing step).

In the polymerizing step, a stirring operation is preferably performed so that the temperature distribution in the container becomes uniform. A polymerization initiator can be added at an arbitrary timing for a required time. In addition, in order to obtain a desired molecular weight distribution, the temperature may be raised in the latter half of the polymerization reaction, and in order to remove unreacted polymerizable monomers, byproducts, and the like to the outside of the system, some of the aqueous medium may be distilled off by a distillation operation in the latter half of the reaction or after the reaction is completed. The distillation operation can be performed under an atmospheric pressure or a reduced pressure.

Regarding the particle diameter of the toner particle, in order to obtain a high definition and high resolution image, the weight-average particle diameter (D4) is preferably at least 3.0 μm and not more than 10.0 μm. The weight-average particle diameter (D4) of the toner will be described below. The toner particle dispersion solution obtained in this manner is subjected to a filtering step for solid-liquid separation of toner particles and the aqueous medium.

The solid-liquid separation for obtaining a toner particle from the obtained toner particle dispersion solution can be performed by a general filtration method. Then, in order to remove foreign substances that are not removed from the surface of the toner particle, it is preferable to perform additional washing according to re-slurry-washing or washing with water. After sufficient washing is performed, solid-liquid separation is performed again to obtain a toner cake. Then, drying is performed by a known drying method, and as necessary, particle groups having a particle diameter other than a predetermined size are separated by classification to obtain a toner particle. In this case, the separated particle groups having a particle diameter other than a predetermined size may be used again in order to improve the final yield.

Method of Measuring Weight-Average Particle Diameter D4 of Toner Particle

The weight-average particle diameter (D4) of the toner particle is calculated as follows. Regarding a measuring device, a precision particle size distribution measuring device "Coulter counter Multisizer3" (registered trademark, commercially available from Beckman Coulter, Inc.) having an aperture tube of 100 μm using a pore electrical resistance method is used. For measurement condition setting and measurement data analysis, bundled dedicated software "commercially available from Beckman Coulter, Inc.Multisizer3Version3.51" (commercially available from Beckman Coulter, Inc.) is used. Here, the measurement is performed with 25000 effective measurement channels.

Regarding an electrolyte aqueous solution used for measurement, "ISOTONII" (commercially available from Beckman Coulter, Inc.) obtained by dissolving special grade sodium chloride in deionized water so that the concentration is about 1 mass % is used.

Here, before measurement and analysis are performed, the dedicated software is set as follows.

On the screen "Change standard measurement method (SOMME)" in the dedicated software, the total count number in the control mode is set to 50000 particles, the number of measurements is set to 1, and the Kd value is set to a value obtained using "standard particles 10.0 μm" (commercially available from Beckman Coulter, Inc.). When "the threshold value/noise level measurement button" is pressed, the threshold value and the noise level are automatically set. In addition, the current is set to 1,600 μA, the gain is set to 2, the electrolyte solution is set to ISOTONII, and "flush aperture tube after measurement" is checked.

On the screen "conversion setting from pulse to particle diameter" in the dedicated software, the bin interval is set to a logarithmic particle diameter, the particle diameter bin is set to a 256 particle diameter bin, and the particle diameter range is set to 2 μm to 60 μm.

A specific measurement method is as follows.

(1) About 200 mL of the electrolyte aqueous solution is put into a 250 mL glass round-bottom beaker dedicated for Multisizer3, the beaker is set on a sample stand, and stirring is performed using a stirrer rod counterclockwise at 24 revolutions/second. Then, dust and bubbles in the aperture tube are removed according to the function "flush aperture tube" in the dedicated software.

(2) About 30 mL of the electrolyte aqueous solution is put into a 100 mL glass flat-bottomed beaker. About 0.3 ml of a diluted solution obtained by diluting "Contaminone N" (a 10 mass % aqueous solution of a neutral detergent for washing a precision measurement instrument which includes a nonionic surfactant, an anionic surfactant, and an organic builder and has pH 7, commercially available from Wako Pure Chemical Industries, Ltd.) in deionized water by a factor of about 3 (based on the mass) is added thereto as a dispersant.

(3) An ultrasonic disperser "Ultrasonic Dispersion System Tetral50" (commercially available from Nikkaki Bios Co., Ltd.) with an electrical output of 120 W into which two oscillators with an oscillation frequency of 50 kHz and of which phases are shifted by 180 degrees are built is prepared. About 3.3 L of deionized water is put into a water tank of the ultrasonic disperser, and about 2 mL of Contaminone N is added to the water tank.

(4) The beaker in the above (2) is set in a beaker fixing hole of the ultrasonic disperser and the ultrasonic disperser is operated. Then, the height position of the beaker is adjusted so that the resonance state of the liquid level of the electrolyte aqueous solution in the beaker is maximized.

(5) While an ultrasound is emitted to the electrolyte aqueous solution in the beaker in the above (4), small amounts of about 10 mg of the toner particle are added to and dispersed in the electrolyte aqueous solution. Then, an ultrasonic dispersion treatment additionally continues for 60 seconds. Here, in ultrasonic dispersion, the temperature of water in the water tank is appropriately adjusted to at least 10° C. and not more than 40° C.

(6) The electrolyte aqueous solution in the above (5) in which toner particles are dispersed is added dropwise to the round-bottom beaker in the above (1) placed in the sample stand using a pipette, and the measurement concentration is adjusted to about 5%. Then, measurement is performed until the number of measured particles is 50000.

(7) Measurement data is analyzed using the dedicated software bundled in the device and the weight-average particle diameter (D4) is calculated. Here, "average diameter" on the screen "analysis/volume statistic value (arithmetic mean)" when graph/volume % is set in the dedicated software is set to weight-average particle diameter (D4).

Examples

Hereinafter, unless otherwise specified, "parts" of materials are all based on the mass.

In Embodiment 1, a toner a in which inorganic silicon fine particles and a metal soap were externally added was produced using the above toner production method.

Table 2 shows external addition conditions for the toner a. Here, details of the speed and time in the external addition conditions were the same as those described in Japanese Patent Application Laid-open No. 2016-38591.

In addition, the metal soap externally added together with inorganic silicon fine particles was zinc stearate.

A method of producing the toner a to be used will be described.

(Step of Preparing an Aqueous Medium 1)

14.0 parts of sodium phosphate (12 hydrate, commercially available from Rasa Industries, Ltd.) was put into 1000.0 parts of deionized water in a reaction container and the mixture was kept at 65° C. for 1.0 hours while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added together to prepare an aqueous medium containing a dispersion stabilizer. In addition, 10 mass % hydrochloric acid was added to the aqueous medium, pH was adjusted to 5.0, and thereby an aqueous medium 1 was obtained.

(Step of Preparing a Polymerizable Monomer Composition)

| | |
|---|---|
| Styrene: | 60.0 parts |
| C.I. Pigment blue15:3: | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene: | 20.0 parts |
| n-butyl acrylate: | 20.0 parts |
| Cross-linking agent (divinylbenzene): | 0.3 parts |
| Saturated polyester resin: (polycondensate of propylene oxide modified bisphenol A (2 mol adduct) and terephthalic acid (molar ratio 10:12), glass transition temperature Tg = 68° C., weight-average molecular weight Mw = 10000, and molecular weight distribution Mw/Mn = 5.12) | 5.0 parts |
| Fischer-Tropsch wax (melting point 78° C.): | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

(Granulating Step)

The temperature of the aqueous medium 1 was set to 70° C., and while maintaining the rotational speed of the T. K. Homomixer at 12000 rpm, the polymerizable monomer composition was added to the aqueous medium 1, and 9.0 parts of t-butyl peroxypivalate as a polymerization initiator was added. Granulation was performed for 10 minutes while maintaining 12000 rpm in the stirring device without change.

(Polymerizing Step)

After the granulating step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours. The temperature of the obtained slurry was cooled to obtain a toner particle slurry.

Washing and Drying Step

Hydrochloric acid was added to the toner particle slurry so that pH was adjusted to 1.5 or less, the mixture was stirred and left for 1 hour, and solid-liquid separation was then performed using a pressure filter, and a toner cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner cake.

The obtained toner cake was dried using an airflow dryer flash jet dryer (commercially available from Seishin Enterprise Co., Ltd.), and additionally, fine powder was cut using a multi-grade classifier using a Coanda effect to obtain toner particles a. Regarding drying conditions, the blowing temperature was set to 90° C., the dryer outlet temperature was set to 40° C., and the toner cake supply speed was adjusted to a speed at which the outlet temperature did not deviate from 40° C. according to the content of water of the toner cake.

Producing Inorganic Silicon Fine Particles 590.0 g of methanol, 42.0 g of water, and 48.0 g of 28 mass % ammonia water were put into a 3 L glass reaction container including a stirrer, a dripping funnel, and a thermometer, and mixed. The obtained solution was adjusted to 35° C., and while stirring, addition of 1100.0 g (7.23 mol) of tetramethoxysilane and 395.0 g of 5.5 mass % ammonia water started at the same time. Tetramethoxysilane was added dropwise over 6 hours and ammonia water was added dropwise over 5 hours. After dropwise addition was completed, additionally, stirring continued for 0.5 hours, hydrolysis was performed, and thereby a methanol-water dispersion solution containing hydrophilic spherical sol-gel silica fine particles was obtained. Next, an ester adapter and a cooling pipe were attached to the glass reaction container, and the dispersion solution was sufficiently dried at 80° C. under a reduced pressure. The obtained silica particles were heated in a thermostatic tank at 400° C. for 10 minutes.

The obtained silica fine particles were deagglomerated using a pulverizer (commercially available from Hosokawa Micron Corporation).

Then, 500 g of silica fine particles was put into a polytetrafluoroethylene inner cylinder type stainless steel autoclave with an internal volume of 1000 mL. The inside of the autoclave was purged with nitrogen gas. Then, while rotating a stirring blade bundled in the autoclave at 400 rpm, 0.5 g of HMDS (hexamethyldisilazane) and 0.1 g of water were atomized through a two-fluid nozzle and sprayed uniformly to silica fine particles. After stirring for 30 minutes, the autoclave was sealed and heated at 220° C. for 2 hours. Subsequently, the system was depressurized while being heated and subjected to a deammonia treatment, and silica fine particles (inorganic silicon fine particles, the number-average particle diameter of primary particles was 80 nm) were obtained.

External Addition of Inorganic Silicon Fine Particles and Metal Soap

The silica fine particles and a metal soap were externally added to the toner particles a according to the method described in the example in Japanese Patent Application Laid-open No. 2016-38591, and thereby a toner a was obtained.

That is, with respect to the toner particles a, the silica fine particles (such that the content in the toner satisfied conditions in the table) and zinc stearate (the content in the toner became 0.20 mass %) were subjected to a two-step treatment under conditions shown in the table using a device a (surface modification device) 101 shown in FIG. 7 to FIG. 11. Then, coarse particles were removed using a sieve having 200 meshes, and thereby a toner a was obtained.

Figure 7:
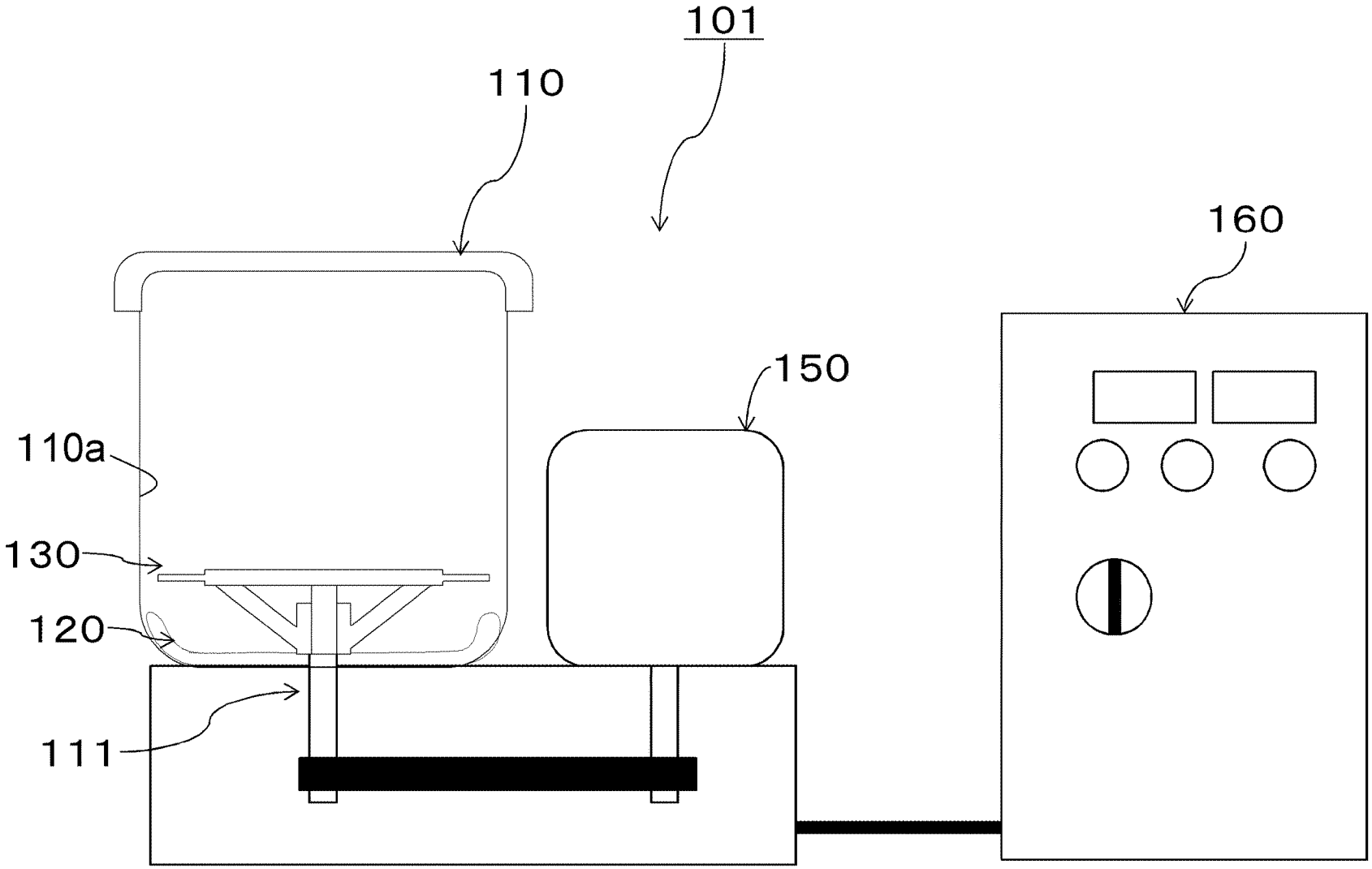
FIG. 7 is a schematic view showing a surface modification device according to an embodiment of the present invention.
Figure 8:
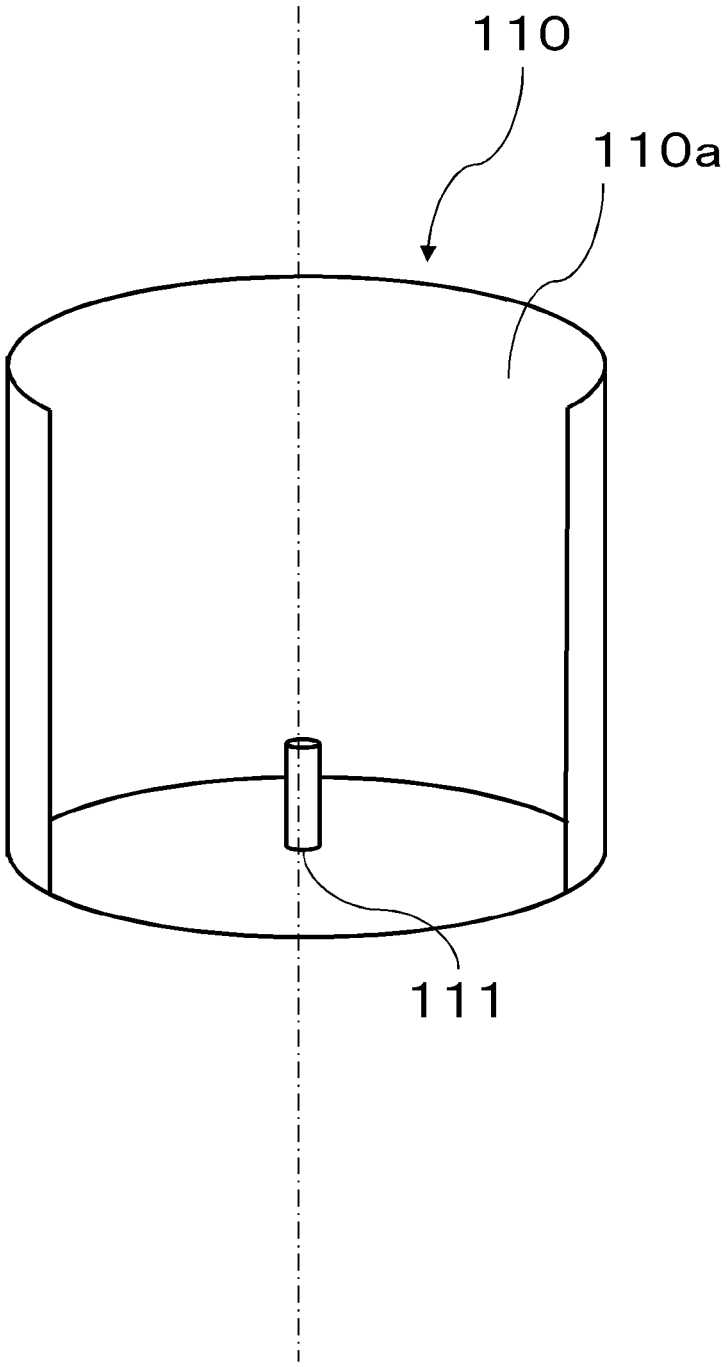
FIG. 8 is a schematic view showing a processing chamber of a surface modification device used in an embodiment of the present invention.
Figure 9A:
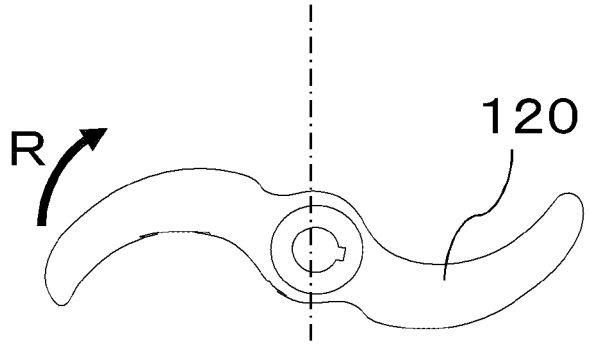
FIGS. 9A and 9B are schematic views showing a stirring blade of a surface modification device used in an embodiment of the present invention.
Figure 9B:
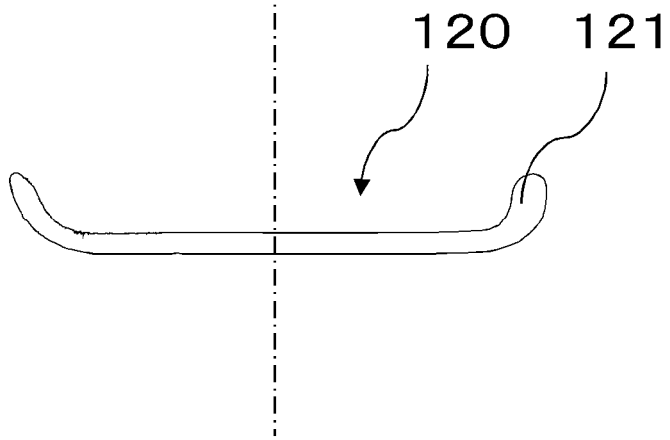
Figure 10A:
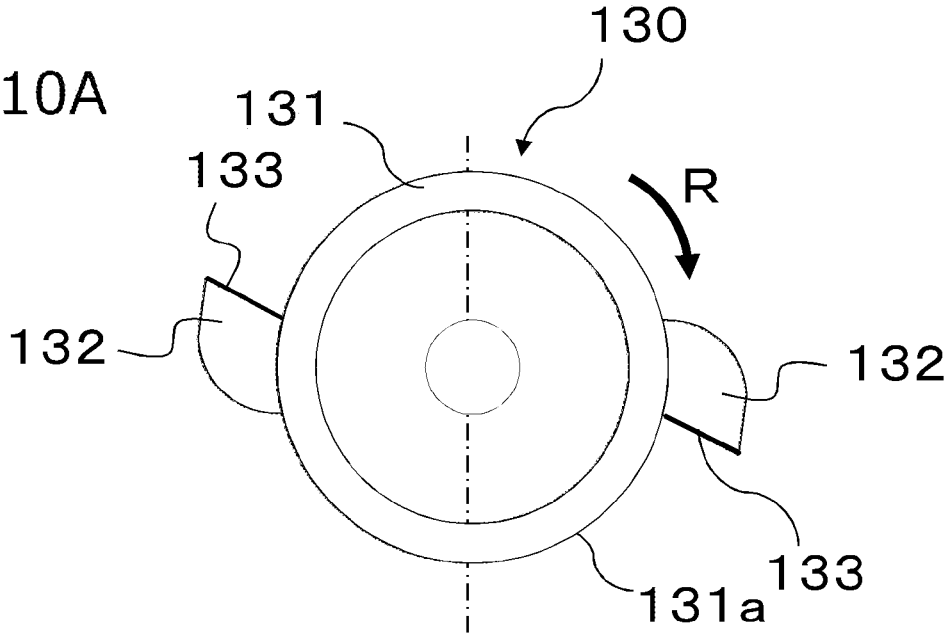
FIGS. 10A and 10B are schematic views showing a rotating body of a surface modification device used in an embodiment of the present invention.
Figure 10B:
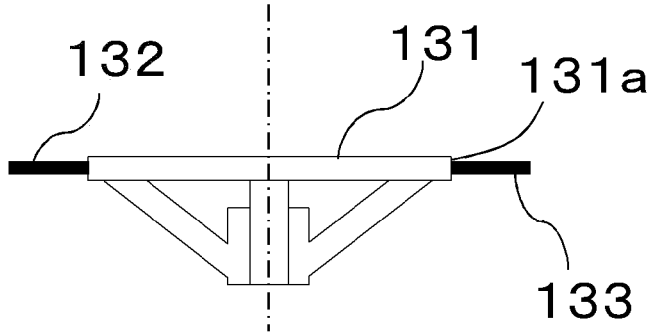
Figure 11A:
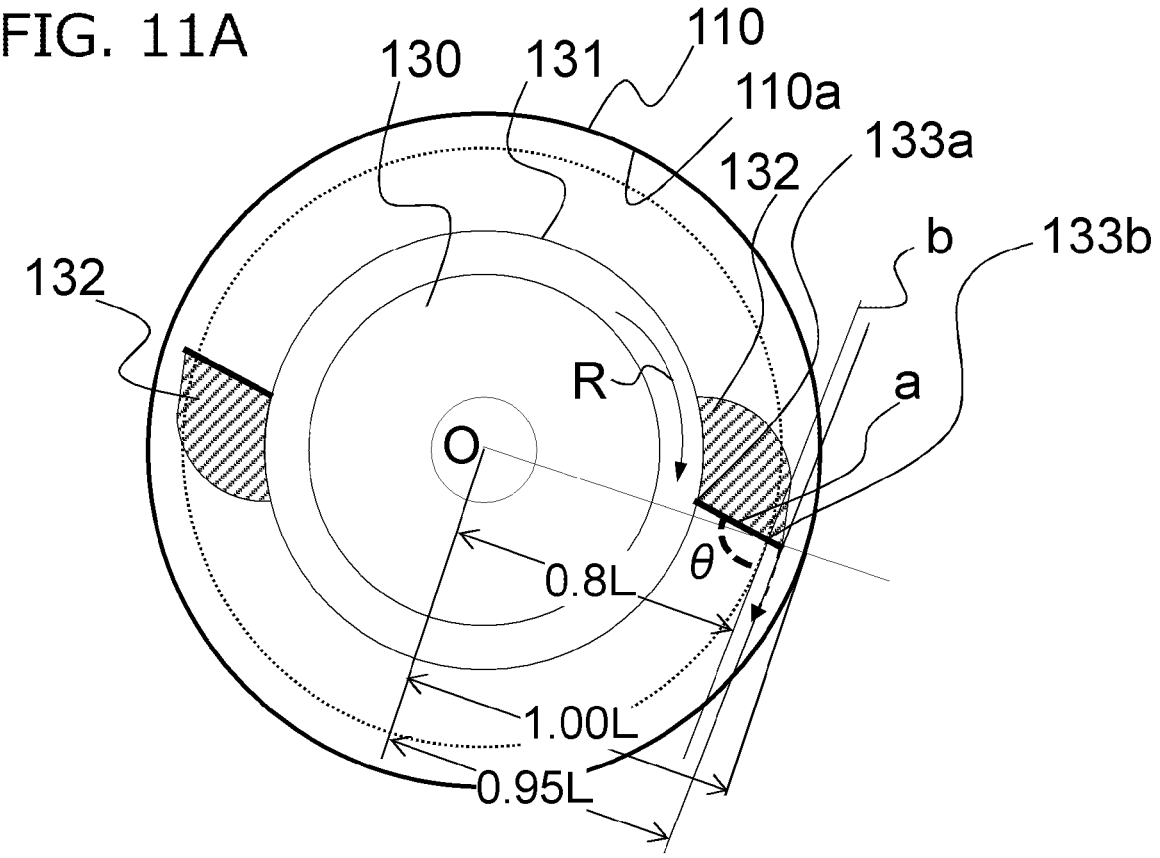
FIGS. 11A, 11B and 11C are schematic views showing a rotating body of a surface modification device used in an embodiment of the present invention.
Figure 11B:
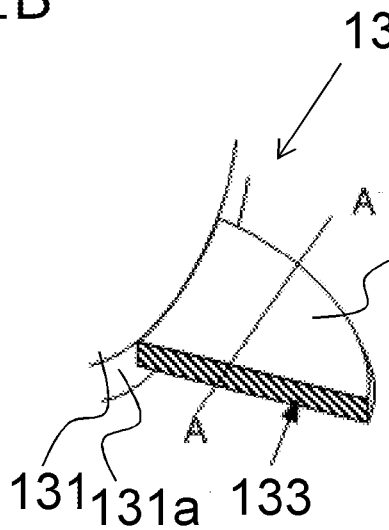
Figure 11C:
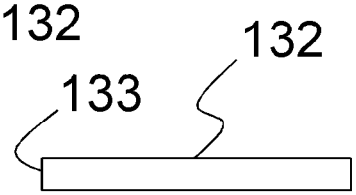

As shown in FIG. 7, the toner processing device 101 includes a processing chamber (processing tank) 110, a stirring blade 120 as a lifting member, a rotating body 130, a drive motor 150, and a control unit 160. In the processing chamber 110, a workpiece containing toner particles and an external additive is stored. The stirring blade 120 is rotatably provided at the bottom of the processing chamber 110 and below the rotating body 130 in the processing chamber. The rotating body 130 is rotatably provided above the stirring blade 120. FIG. 8 shows a schematic view of the processing chamber 110. FIG. 8 shows a state in which an inner circumferential surface (inner wall) 110*a* of the processing chamber 110 is partially cut for convenience of explanation. The processing chamber 110 is a cylindrical container having a substantially flat bottom, and includes a drive shaft 111 for attaching the stirring blade 120 and the rotating body 130 to the substantially center of the bottom. FIGS. 9(*a*) and 9(*b*) are schematic views of the stirring blade 120 as a lifting member (the top view in FIG. 9A, and the side view in FIG. 9B). When the stirring blade 120 rotates, a workpiece containing toner particles and an external additive can be lifted in the processing chamber 110. The stirring blade 120 has a blade part 121 that extends from the rotation center to the outside (radially outward (outer diameter direction), outer diameter side), and the tip of the blade part 121 has a flip-up shape so that the workpiece is lifted. The stirring blade 120 is fixed to the drive shaft 111 at the bottom of the processing chamber 110 and rotates clockwise (arrow R direction) when viewed from the above (in the state shown in FIG. 9A). When the stirring blade 120 rotates, the workpiece rises while being rotated in the same direction as the stirring blade 120 in the processing chamber 110 and is eventually lowered due to gravity. In this manner, the workpiece is uniformly mixed. FIGS. 10A and 10B and FIGS. 11A, 11B and 11C show schematic views of the rotating body 130. FIG. 10A is a top view of the rotating body 130, and FIG. 10B is a side view thereof. FIG. 11A is a top view showing the rotating body 130 provided in the processing chamber 110. FIG. 11B is a perspective view showing main parts of the rotating body 130, and FIG. 11C is a diagram showing the cross section taken along the line A-A in FIG. 10B. The rotating body 130 is positioned above the stirring blade 120 in the processing chamber 110 and fixed to the same drive shaft 111 for the stirring blade 120, and rotates in the same direction (arrow R direction) as the stirring blade 120. The rotating body 130 includes a rotating body main body 131 and a processing unit 132 having a processing surface 133 that collides with a workpiece according to rotation of the rotating body 130 and processes the workpiece. The processing surface 133 extends from an outer circumferential surface 131*a* of the rotating body main body 131 in the outer diameter direction and is formed such that a region of the processing surface 133 away from the rotating body main body 131 is positioned downstream in the rotation direction of the rotating body 130 from a region closer to the rotating body main body 131 than the region. That is, in FIG. 11A, the processing surface 133 is disposed so that it is inclined in the rotation direction R of the rotating body 130 with respect to the radial direction of the rotating body 130. When the rotating body 130 rotates, the workpiece collides with the processing surface 133, the external additive aggregate is deagglomerated.

TABLE 2

| | First Step external addition conditions | | | | Second Step external addition conditions | | | | |
|---|---|---|---|---|---|---|---|---|---|
| | Content of silica fine particles mass % | Device | Peripheral speed (m/s) | Time (sec) | Content of silica fine particles mass % | Device | Peripheral speed (m/s) | Time (sec) | Metal soap zinc stearate (mass %) |
| Toner a | 0.60 | Device a | 40 | 300 | 0.60 | Device a | 40 | 60 | 0.20 |

In Embodiment 1, the surface of the photosensitive member was subjected to a roughening treatment so that microscopic unevennesses were formed on the surface of the photosensitive member, and the metal soap externally added to toner particles was supplied and attached to the unevennesses so that an amount of the metal soap on the surface of the photosensitive member was maintained and the occurrence of image smearing was reduced.

The surface of the photosensitive member was subjected to a roughening treatment, the ten-point average surface roughness (Rz) of the circumferential surface of the image bearing member was $0<Rz\leq0.70$ (μm), (preferably $0.10\leq Rz\leq0.50$ (μm)), and the average interval (Sm) between unevennesses on the circumferential surface was $0<Sm\leq70$ (μm) (preferably $5\leq Sm\leq70$ (μm)) The average interval (Sm) between unevennesses can also be considered as the average interval between concave-convex portions on the circumferential surface. The concave portions may be thought of as the grooves 1*b* and the convex portions as the flat parts 1*c*. Within the above range, it was possible to stably maintain the metal soap on the surface of the image bearing member (photosensitive member), and as a result, it was possible to reduce the occurrence of image smearing for a long time.

The ten-point average surface roughness (Rz) of the circumferential surface of the image bearing member and the average interval (Sm) between unevennesses were based on JIS standards (JIS B 0601), and measured using a surface roughness measurement instrument Surfcorder SE3500 type (commercially available from Kosaka Laboratory Ltd.) under the following conditions.

Detector: R2 μm 0.7 mN of diamond needle

Filter: 2CR

Cut-off value: 0.8 mm

Measurement length: 2.5 mm

Feeding speed: 0.1 mm

Here, in the present invention, in 3 parts of the photosensitive member in the busbar direction, 4 parts each in the respective parts in the circumferential direction were measurement parts (a total of 12 parts).

On the other hand, the average interval (Sm) of unevennesses on the circumferential surface of the image bearing member was able to be defined as an interval between the plurality of grooves 1*b* in the busbar direction (longitudinal direction) aligned in the busbar direction of the circumferential surface 1*a* as shown in FIG. 6B, or an interval in the busbar direction (longitudinal direction) of the flat part 1*c*.

Regarding Examples 1 to 3 and Comparative Examples 1 and 2 of the present invention, combinations of the toner a and photosensitive members having different surface roughness as shown in Table 3 were prepared.

TABLE 3

| | Toner | Photosensitive member |
|---|---|---|
| Example 1 | Toner a | Photosensitive member a |
| Example 2 | Toner a | Photosensitive member b |

TABLE 3-continued

| | Toner | Photosensitive member |
|---|---|---|
| Example 3 | Toner a | Photosensitive member c |
| Cornparative Example 1 | Toner a | Photosensitive member d |
| Comparative Example 2 | Toner a | Photosensitive member e |

Experiment

In order to check the occurrence of image smearing in Examples 1 to 3, and Comparative Examples 1 and 2, 10000 sheets per day were continuously passed at a 1% print percentage and then left in the machine for a day, and then the presence or absence of image smearing after being left was compared.

In the image smearing test, one halftone image was printed and evaluated.

Evaluation was as follows.

O: Not occurred (There were no blank dots due to latent image rounding or contour blurring at the boundary of the image in the entire image)

x: Occurred (Blank dots due to latent image rounding or contour blurring at the boundary of the image occurred in a part of the image or the entire image)

Paper passing and testing were performed in an environment at 32° C. and 80% RH. The total number of sheets that passed was 50000 sheets.

In addition, a photosensitive member surface speed was 296 mm/s, a developing roller surface speed was 425 mm/s, a photosensitive member surface potential was −500 V, a developing roller applied voltage was −350 V, a supply roller voltage was −450 V, and a regulating member voltage was −450 V.

Experiment results are shown in Table 4.

TABLE 4

| | The number of sheets that passed (* 1000) | | | | |
|---|---|---|---|---|---|
| | 10 | 20 | 30 | 40 | 50 |
| Example 1 | ○ | ○ | ○ | ○ | ○ |
| Example 2 | ○ | ○ | ○ | ○ | ○ |
| Example 3 | ○ | ○ | ○ | ○ | ○ |
| Comparative Example 1 | ○ | ○ | ○ | X | X |
| Comparative Example 2 | ○ | ○ | ○ | X | X |

"○" means "Image smearing not occurred"

"X" means "Image smearing occurred"

As shown in Table 4, in Examples 1 to 3, there was no image smearing throughout the experiment. On the other hand, in Comparative Example 2 using a photosensitive member that had not been subjected to a roughening treatment, no image smearing occurred with up to 30000 sheets, but image smearing occurred with 40000 sheets. This is thought to be caused by the fact that, since the metal soap was filled into the grooves formed on the surface of the photosensitive member according to a roughening treatment, the metal soap was not removed by the cleaning blade and could remain on the surface of the photosensitive member, and as a result, an image smearing reduction effect was maintained.

On the other hand, in the photosensitive member that had not been subjected to a roughening treatment of Comparative Example 2, Sm indicating the average interval between unevennesses on the circumferential surface of the photosensitive member was large, the end surface of the cleaning blade followed the entire longitudinal surface of the photosensitive member without any gap, and the supplied metal soap was removed, and thereby an image smearing reduction effect of the metal soap was not exhibited.

In addition, in Comparative Example 1, in spite of the photosensitive member that had been subjected to a roughening treatment, image smearing occurred with 40000 sheets in the same manner as in Comparative Example 2 in which a roughening treatment was not performed. Since deep grooves were formed in the photosensitive member d of Comparative Example 2, a large amount of the metal soap was necessary until the grooves were filled, and a sufficient effect was not exhibited.

Generally, if wearing of the photosensitive member was reduced, the surface of the photosensitive member was less likely to be refreshed, and an image defect called image smearing was likely to occur in a high humidity environment.

The toner in which the metal soap was externally added to toner particles was effective in image smearing, but it was difficult to maintain an effect in which the metal soap was scraped off from the photosensitive member by the cleaning blade.

In the configuration of Embodiment 1, the surface of the photosensitive member was subjected to a roughening treatment, and the range of the ten-point average surface roughness (Rz) of the circumferential surface of the image bearing member was $0<Rz\leq 0.70$ (μm), and the range of the average interval (Sm) between unevennesses on the circumferential surface was $0<Sm\leq 70.0$ (μm). When parameters were controlled such that they were within the above ranges, the metal soap was stably maintained on the surface of the photosensitive member, and thus it was possible to reduce the occurrence of image smearing for a long time.

Embodiment 2

In Embodiment 1 of the present invention, a case in which a toner in which inorganic silicon fine particles were externally added as shown in FIG. 4 was used has been described.

The inventors conducted experiments by performing some modifications on the state of the surface layer of the toner, and found that a toner in which fine particles containing organosilicon polymers were present on the surface of toner particles had a favorable effect.

This is because, as in Embodiment 1, in a toner in which inorganic silicon fine particles were present on the surface of toner particles, inorganic silicon fine particles easily scraped the surface of the photosensitive member, and deep scratches (grooves) were locally generated on the surface of the photosensitive member.

As a result, supply of the metal soap to the deep scratch parts was insufficient, and image smearing occurred.

On the other hand, in the case of a toner in which fine particles containing organosilicon polymers in place of inorganic silicon fine particles were present on the surface of toner particles, it was considered that, since it had a lower surface free energy and a lower friction than in the case of inorganic silicon fine particles, deep scratches were unlikely to enter the surface of the photosensitive member.

In Embodiment 2 of the present invention, when a toner in which fine particles containing organosilicon polymers were present on the surface of toner particles was used, the occurrence of image smearing was reduced with a simple configuration while maintaining durability of the photosensitive member also in a configuration for a longer lifespan. Here, descriptions of parts of Embodiment 2 the same as those of Embodiment 1 will be omitted.

Toner in Which Fine Particles Containing Organosilicon Polymers are Present on The Surface of Toner Particles In Embodiment 2, a developing agent contains a toner including toner particles, fine particles present on the surface of the toner particles, and a metal soap, the fine particles containing an organosilicon polymer having a structure represented by the following Formula (L).

$$R—SiO_{3/2} \quad (1)$$

R represents a hydrocarbon group having at least 1 and not more than 6 carbon atoms. In addition, R is preferably an aliphatic hydrocarbon group or phenyl group having at least 1 and not more than 5 carbon atoms and more preferably an aliphatic hydrocarbon group having at least 1 and not more than 3 carbon atoms. Preferable examples of an aliphatic hydrocarbon group having at least 1 and not more than 3 carbon atoms include a methyl group, an ethyl group, a propyl group, and a vinyl group.

In addition, the adhesion rate of the fine particles was preferably at least 30% and not more than 90%.

Fine Particles Containing Organosilicon Polymers

Fine particles containing organosilicon polymers were preferably fine particles containing a polyalkylsilsesquioxane obtained by dehydration condensation of alkyltrialkoxysilane and more preferably polyalkylsilsesquioxanefine particles.

Here, the polyalkylsilsesquioxane was a network type polymer having a structure of $R—SiO_{3/2}$ (R represents a hydrocarbon group having at least 1 and not more than 6 carbon atoms) obtained by hydrolyzing a trifunctional silane.

Regarding the alkyltrialkoxysilane, methyltrimethoxysilane, methyltriethoxysilane, methyltriisopropoxysilane, ethyltrimethoxysilane, n-propyltriethoxysilane, n-butyltrimethoxysilane, isobutyltrimethoxysilane, isobutyltriethoxysilane, n-hexylmethoxysilane, n-hexyltriethoxysilane, and the like can be used. These may be used alone or two or more types thereof may be used in combination.

Method of Producing Fine Particles Containing Organosilicon Polymers 200.0 g of water and 0.1 g of acetic acid as a catalyst were put into a 2000 mL flask and stirred at 30° C. Here, 100.0 g of methyltrimethoxysilane was added thereto and the mixture was stirred for 2 hours. This was referred to as a step A.

150 g of water, 200.0 g of methanol, and 5 g of sodium hydroxide were put into a 500 mL flask, and stirred at 30° C. for 5 minutes to produce an alkaline aqueous catalyst. This alkaline aqueous catalyst was put into the 2000 mL flask in the step A. Then, stirring was performed for 10 minutes. This was referred to as a step B.

2,500 g of water was put into a 5000 mL flask, and while stirring at 35° C., the entire amount of the aqueous solution obtained in the step B was put thereinto. Then, stirring continued for 8 hours, and a dispersion solution containing polymethylsilsesquioxane fine particles was obtained. This was referred to as a step C.

The dispersion solution obtained in the step C was suctioned and filtered and a polymethylsilsesquioxane fine particle cake was formed. In addition, washing with methanol was performed twice. Then, drying was performed at 40° C. for 24 hours under a reduced pressure, and thereby white fine particles were obtained. Then, the white fine particles were sieved by an air classifier and the particle diameter thereof was adjusted. Thereby, polymethylsilsesquioxane fine particles (A) were obtained. The number-average particle diameter of the polymethylsilsesquioxane fine particles (A) was 102 nm.

Method of Measuring Number-Average Particle Diameter of Fine Particles Containing Organosilicon Polymers The number-average particle diameter of the fine particles was measured from an image of fine particles obtained by performing enlargement at a magnification of 100000 using a field emission scanning electron microscope (FE-SEM) (S-4800, commercially available from Hitachi High-Technologies Corporation).

First, a solution in which fine particles were suspended in methanol so that the concentration was about 0.5 mass % and dispersed for 1 minute in a homogenizer (with an output of 20 W) was prepared. Then, the solution was added dropwise to a pedestal for observation and dried by air. This was subjected to platinum deposition for 30 seconds and an image enlarged at a magnification of 100000 was obtained using the FE-SEM. Next, the obtained image was printed, but at that time, a plurality of images (100 or more) to be measured were output. 100 pieces were selected randomly from these printed matters and the long diameter was measured using a caliper. The arithmetic mean value of long diameters of the 100 pieces was set as the number-average particle diameter (unit: nm).

Production Example of Toner 400 parts by mass of deionized water and 450 parts by mass of a 0.1 M-$Na_3PO_4$ aqueous solution were put into a 20 L reaction container, and heated to 60° C., and stirring was then performed at 6,000 rpm using a TK Homomixer (commercially available from Tokushu Kika Kogyo Co., Ltd.). 68 parts of a 1.0 M-$CaCl_2$ aqueous solution was added thereto and an aqueous medium containing calcium phosphate was obtained.

Here,

| | |
|---|---|
| styrene | 75 parts |
| n-butyl acrylate | 25 parts |
| C.I. Pigment Blue 15:3 | 5 parts |
| polyester resin (weight-average molecular weight = 12,500, acid value = 5.5 mgKOH/g) | 5 parts |
| dialkyl salicylic acid aluminum compound | 1 part |
| hydrocarbon wax (endothermic peak = 80° C., half width = 8, weight-average molecular weight = 750) | 3 parts |
| ester wax (endothermic peak = 67° C., half width = 4, weight-average molecular weight = 690) | 9 parts |
| divinylhenzene | 0.05 parts |

The formulation was put into a 5 L container and uniformly dissolved and dispersed while heating to 60° C. using a TK Homomixer (commercially available from Tokushu Kika Kogyo Co., Ltd.) at 5,000 rpm. 3.5 parts of a polymerization initiator 2,2'-azobis(2,4-dimethylvaleronitrile) was dissolved therein and thereby a polymerizable monomer composition was prepared. The polymerizable monomer composition was added to the aqueous medium, and stirring was performed at 70° C. under a $N_2$ atmosphere at 10,000 rpm using a TK Homomixer, and polymerizable monomer composition droplets were granulated.

Then, when the polymerization conversion rate of the polymerizable vinyl monomer reached 90% while performing stirring using a paddle stirring blade, a 0.1 mol/L sodium hydroxide aqueous solution was added so that pH of the aqueous dispersion medium was adjusted to 8.

In addition, the temperature was raised to 80° C. at a heating rate of 40° C./hr and the reaction was caused for 4 hours.

After the polymerization reaction was completed, residual monomers were distilled off under a reduced pressure. After cooling, hydrochloric acid was added so that pH was adjusted to 1.4, the mixture was stirred for 3 hours, and thereby calcium phosphate was dissolved.

After filtration and washing with water, drying was performed at 40° C. for 48 hours, and fine powder and coarse powder were removed by air classification, and thereby toner particles b were obtained. The weight-average particle diameter (D4) of the toner particles b was 7.0 μm.

2.0 parts of polymethylsilsesquioxane fine particles (A) and zinc stearate (such that the content in the toner was 0.20 mass %) were externally added to 100 parts of the toner particles according to a method to be described below, and thereby a toner b of this example was obtained.

Method of Measuring Weight-Average Particle Diameter D4 of Toner Particles

The weight-average particle diameter (D4) of toner particles was calculated as follows. Regarding a measuring device, a precision particle size distribution measuring device "Coulter counter Multisizer3" (registered trademark, commercially available from Beckman Coulter, Inc.) having an aperture tube of 100 μm using a pore electrical resistance method was used. For measurement condition setting and measurement data analysis, bundled dedicated software "commercially available from Beckman Coulter, Inc.Multisizer3Version3.51" (commercially available from Beckman Coulter, Inc.) was used. Here, the measurement was performed with 25,000 effective measurement channels.

Regarding an electrolyte aqueous solution used for measurement, "ISOTONII" (commercially available from Beckman Coulter, Inc.) obtained by dissolving special grade sodium chloride in deionized water so that the concentration is about 1 mass % was used.

Here, before measurement and analysis were performed, the dedicated software was set as follows.

On the screen "Change standard measurement method (SOMME)" in the dedicated software, the total count number in the control mode was set to 50000 particles, the number of measurements was set to 1, and the Kd value was set to a value obtained using "standard particles 10.0 μm" (commercially available from Beckman Coulter, Inc.). When "the threshold value/noise level measurement button" was pressed, the threshold value and the noise level were automatically set. In addition, the current was set to 1,600 μA, the gain was set to 2, the electrolyte solution was set to ISOTONII, and "flush aperture tube after measurement" was checked.

On the screen "conversion setting from pulse to particle diameter" in the dedicated software, the bin interval was set to a logarithmic particle diameter, the particle diameter bin was set to a 256 particle diameter bin, and the particle diameter range was set to 2 μm to 60 μm.

A specific measurement method was as follows.

(1) About 200 mL of the electrolyte aqueous solution was put into a 250 mL glass round-bottom beaker dedicated for Multisizer3, the beaker was set on a sample stand, and stirring was performed using a stirrer rod counterclockwise at 24 revolutions/second. Then, dust and bubbles in the aperture tube were removed according to the function "flush aperture tube" in the dedicated software.

(2) About 30 mL of the electrolyte aqueous solution is put into a 100 mL glass flat-bottomed beaker. About 0.3 ml of a diluted solution obtained by diluting "Contaminone N" (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) in deionized water by a factor of about 3 (based on the mass) is added thereto as a dispersant.

(3) An ultrasonic disperser "Ultrasonic Dispersion System Tetral50" (commercially available from Nikkaki Bios Co., Ltd.) with an electrical output of 120 W into which two oscillators with an oscillation frequency of 50 kHz and of which phases were shifted by 180 degrees were built was prepared. About 3.3 L of deionized water was put into a water tank of the ultrasonic disperser, and about 2 mL of Contaminone N was added to the water tank.

(4) The beaker in the above (2) was set in a beaker fixing hole of the ultrasonic disperser and the ultrasonic disperser was operated. Then, the height position of the beaker was adjusted so that the resonance state of the liquid level of the electrolyte aqueous solution in the beaker was maximized.

(5) While an ultrasound was emitted to the electrolyte aqueous solution in the beaker in the above (4), small amounts of about 10 mg of the toner particle were added to and dispersed in the electrolyte aqueous solution. Then, an ultrasonic dispersion treatment additionally continued for 60 seconds. Here, in ultrasonic dispersion, the temperature of water in the water tank was appropriately adjusted to at least 10° C. and not more than 40° C.

(6) The electrolyte aqueous solution in the above (5) in which toner particles were dispersed was added dropwise to the round-bottom beaker in the above (1) placed in the sample stand using a pipette, and the measurement concentration was adjusted to about 5%. Then, measurement was performed until the number of measured particles was 50000.

(7) Measurement data was analyzed using the dedicated software bundled in the device and the weight-average particle diameter (D4) was calculated. Here, "average diameter" on the screen "analysis/volume statistic value (arithmetic mean)" when graph/volume % was set in the dedicated software was set to weight-average particle diameter (D4).

Method of Measuring Adhesion Rate of Fine Particles with Respect to Surface of Toner Particles A method of measuring an adhesion rate (%) of the polymethylsilsesquioxane fine particles (A) is as follows.

160 g of sucrose (commercially available from Kishida Chemical Co., Ltd.) was added to 100 mL of deionized water, and dissolved while heating in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. It was visually confirmed that the toner and the aqueous solution were sufficiently separated, and the toner separated in the top layer was collected using a spatula or the like. The aqueous solution containing the collected toner was filtered in a filtration machine under a reduced pressure and drying was then performed in a dryer for 1 hour or longer. The dried product was deagglomerated using a spatula, and an amount of silicon was measured using X-ray fluorescence. An adhesion rate (%) of fine particles with respect to the surface of the toner particles was calculated based on the ratio of amounts of elements to be measured between the toner after washing and the toner before washing.

The X-ray fluorescence of elements was measured according to JIS K 0119-1969, and details are as follows.

Regarding a measuring device, a wavelength dispersive X-ray fluorescence analyzing device "Axios" (commercially available from PANalytical), and bundled dedicated software "SuperQver. 4.0F" (commercially available from PANalytical) for measurement condition setting and measurement data analysis were used. Here, Rh was used as an X-ray tube anode, the measurement atmosphere was a vacuum, the measurement diameter (collimator mask diameter) was 10 mm, and the measurement time was 10 seconds. In addition, when a light element was measured, the X-ray fluorescence was detected by a proportional counter (PC), and when a heavy element was measured, the X-ray fluorescence was detected by a scintillation counter (SC).

Regarding a measurement sample, pellets obtained by putting about 1 g of the toner after washing or the toner before washing into an exclusive aluminum ring for pressing with a diameter of 10 mm and flattening it, and performing pressing at 20 MPa for 60 seconds using a tablet molding compressor "BRE-32" (commercially available from Maekawa Testing Machine MFG. Co., Ltd.), and performing molding to a thickness of about 2 mm were used.

Measurement was performed under the above conditions, an element was identified based on the obtained X-ray peak position, and its concentration was calculated from a counting rate (unit: cps) which was the number of X-ray photons per unit time.

In a quantitative method in the toner, for example, regarding an amount of silicon, for example, 0.5 parts by mass of silica ($SiO_2$) fine powder was added with respect to 100 parts by mass of toner particles, and the mixture was sufficiently mixed using a coffee mill. In the same manner, 2.0 parts by mass and 5.0 parts by mass of silica fine powder were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represented the obtained X-ray counting rate and the horizontal axis represented an amount of $SiO_2$ added in each calibration curve sample was obtained.

Next, the toner to be analyzed was formed into pellets as described above using a tablet molding compressor, and the counting rate of Si-Kα rays was measured. Then, the content of silicon in the toner was obtained from the above calibration curve. The ratio of the amount of silicon in the toner after washing to the amount of silicon in the toner before washing calculated by the above method was obtained and used as an adhesion rate (%).

External Addition Method

The toner of Embodiment 2 was obtained by externally adding polymethylsilsesquioxane fine particles (A) and a metal soap to toner particles b according to the method described in the example in Japanese Patent Application Laid-open No. 2016-38591.

That is, with respect to 100 parts by mass of the toner particles b, 2.00 parts by mass of polymethylsilsesquioxane fine particles (A) and zinc stearate (the content in the toner became 0.20 mass %) were subjected to a two-step treatment under conditions shown in the table using a device a (surface modification device) 101 shown in FIG. 7 to FIG. 11. Then, coarse particles were removed using a sieve having 200 meshes, and thereby a toner b was obtained.

The content of polymethylsilsesquioxane fine particles in the toner was preferably at least 0.01 parts by mass and not more than 3.00 parts by mass with respect to 100.00 parts by mass of the toner particles.

The adhesion rate of the fine particles with respect to the surface of toner particles obtained by the method could be adjusted by changing the wing tip peripheral speed and time during the two-step treatment.

In the present invention, the adhesion rate is preferably at least 30% and not more than 90%. When the adhesion rate was lower than 30%, opportunities for toner particles to come in contact with each other increased, and thus a toner attachment force changed, and charging performance changed in some cases. In addition, in the external addition method, it was difficult to obtain an adhesion rate of higher than 90%.

In Embodiment 2, when the toner in which organosilicon polymer fine particles were externally added was used, it was possible to maintain the shape of the unevennesses on the surface of the photosensitive member that had been subjected to a roughening treatment such that the range of the ten-point average surface roughness (Rz) on the circumferential surface was $0<Rz\leq0.7$ (μm) and the range of the average interval (Sm) between unevennesses on the circumferential surface was $0<Sm\leq70$ (μm). As a result, it was possible to maintain an image smearing reduction effect of the metal soap. In addition, in a preferable aspect, the toner includes no inorganic silicon fine particles as an external additive.

Example

In Embodiment 2, a toner b in which organosilicon polymer fine particles and a metal soap were externally added was produced using the above toner production method.

Table 5 shows external addition conditions for the toner b. Regarding the metal soap, zinc stearate was externally added in the same manner as in Embodiment 1.

TABLE 5

| | First Step external addition conditions | | | | Second Step external addition conditions | | | | | |
|---|---|---|---|---|---|---|---|---|---|---|
| | Amount of fine particles (A) added parts by mass | Device | Peripheral speed (m/s) | Time (sec) | Amount of fine particles (A) added parts by mass | Device | Peripheral speed (m/s) | Time (sec) | Adhesion rate (%) | Metal soap zinc stearate (mass %) |
| Toner b | 1.00 | Device a | 40 | 200 | 1.00 | Device a | 40 | 40 | 80 | 0.20 |

Combinations of toners and photosensitive members shown in Table 6 were prepared.

TABLE 6

| | Toner | Photosensitive member |
|---|---|---|
| Example 1 | Toner a | Photosensitive member a |
| Example 4 | Toner b | Photosensitive member a |
| Comparative Example 3 | Toner b | Photosensitive member d |

Experiment

In order to check the occurrence of image smearing in Examples 1 and 4, and Comparative Example 3, 10000 sheets per day were continuously passed at a 1% print percentage and then left in the machine for a day, and then the presence or absence of image smearing after being left was compared.

In the image smearing test, one halftone image was printed and evaluated. Evaluation was as follows.

O: Not occurred (There were no blank dots due to latent image rounding or contour blurring at the boundary of the image in the entire image)

x: Occurred (Blank dots due to latent image rounding or contour blurring at the boundary of the image occurred in a part of the image or the entire image)

Paper passing and testing were performed in an environment at 32° C. and 80% RH. The total number of sheets that passed was 70000 sheets.

In addition, a photosensitive member surface speed was 296 mm/s, a developing roller surface speed was 425 mm/s, a photosensitive member surface potential was −500 V, a developing roller applied voltage was −350 V, a supply roller voltage was −450 V, and a regulating member voltage was −450 V.

The experiment results are shown in Table 7.

TABLE 7

| | The number of sheets that passed (*1000) | | | | | | |
|---|---|---|---|---|---|---|---|
| | 10 | 20 | 30 | 40 | 50 | 60 | 70 |
| Example 1 | ○ | ○ | ○ | ○ | ○ | × | × |
| Example 4 | ○ | ○ | ○ | ○ | ○ | ○ | ○ |
| Comparative Example 3 | ○ | ○ | ○ | × | × | × | × |

"○" means "Image smearing not occured"

"×" means "Image smearing occured"

As shown in Table 7, in Example 4 using the toner b containing fine particles containing organosilicon polymers, there was no image smearing throughout the experiment. On the other hand, in Example 1 using the toner a in which inorganic silicon fine particles were externally added, no image smearing occurred with up to 50000 sheets, but image smearing occurred with 60000 sheets. Comparing the surfaces of the photosensitive members, in the photosensitive member of Example 1 when image smearing occurred, deep scratches as in the photosensitive member d used in Comparative Example 3 were locally introduced, and the shape was changed from the initial roughened shape. This is thought to be caused by the fact that the inorganic silicon fine particles externally added to the toner scraped the surface of the photosensitive member at the contact region with the photosensitive member such as a developing part and a cleaning part, and local deep scratches (grooves) were formed. When deep grooves were formed, a large amount of the metal soap was necessary until the grooves were filled, and an image smearing reduction effect was lowered in some cases.

On the other hand, in Example 4 using the toner b containing fine particles containing organosilicon polymers, the initial roughened shape was maintained throughout the experiment. It was considered that, since fine particles containing organosilicon polymers had a lower surface free energy and a lower friction than inorganic silicon fine particles, deep scratches were unlikely to enter the surface of the photosensitive member.

Here, in Comparative Example 3, since the photosensitive member d in which deep grooves were formed from the beginning was used, even if fine particles externally added to the toner b were fine particles containing organosilicon polymers, image smearing occurred with 40000 sheets.

In the configuration of Embodiment 2, when the toner b containing fine particles containing organosilicon polymers was used, it was possible to maintain the range of the ten-point average surface roughness (Rz) on the circumferential surface of the image bearing member in $0<Rz\leq0.70$ (μm), and the range of the average interval (Sm) between unevennesses on the circumferential surface in $0<Sm\leq70.0$ (μm). As a result, it was possible to stably maintain the metal soap on the surface of the photosensitive member drum, and it was possible to reduce the occurrence of image smearing with a simple configuration while maintaining durability of the photosensitive member also in a configuration for a longer lifespan.

Embodiment 3

In Embodiment 1 of the present invention, a case in which a toner in which inorganic silicon fine particles were externally added as shown in FIG. 4 was used has been described.

In addition, in Embodiment 2, a case in which a toner in which fine particles containing organosilicon polymers were present on the surface of toner particles was used has been described.

Next, Embodiment 3 will be described.

In Embodiment 3, a developing agent related to a toner including toner particles, an organosilicon polymer covering the surface of the toner particles, and a metal soap, the organosilicon polymer having a structure represented by the following Formula (1).

$$R—SiO_{3/2} \quad (1)$$

wherein R represents a hydrocarbon group having at least 1 and not more than 6 carbon atoms.

Compared with the case in which the toner of Embodiment 2 was used, in the toner, since organosilicon polymers were unlikely to be separated from the toner, it was possible to efficiently supply only the metal soap to grooves of the photosensitive member.

In the following description, description of parts the same as in the above embodiment will be omitted.

Toner

In Embodiment 3, a toner including toner particles and an organosilicon polymer covering the surface of the toner particles, the organosilicon polymer having a structure represented by Formula (1), was used.

When the surface of toner particles was covered with organosilicon polymers having a structure represented by Formula (1), the toner particles had the surface layer which was a layer present on the outmost surface of the toner particles. That is, the toner particles had a surface layer containing organosilicon polymers having a structure represented by Formula (1).

The surface layer was very hard compared to conventional toner particles. Therefore, in consideration of fixing performance, a part in which no surface layer was formed on a part of the surface of toner particles was preferably provided.

However, the proportion of the number of division axes in which the thickness of the surface layer containing organosilicon polymers was 2.5 nm or less (hereinafter, the proportion of the surface layer with a thickness of 2.5 nm or less) was preferably 20.0% or less. This condition approximated the case in which at least 80.0% or more of the surface of toner particles was formed of a surface layer containing organosilicon polymers of 2.5 nm or more. That is, when this condition was satisfied, the surface layer containing organosilicon polymers sufficiently covered the surface of toner particles. 10.0% or less was more preferable. Although measurement was performed according to observation of the cross section using a transmission electron microscope (TEM), details will be described below.

Organosilicon Polymer Having Structure Represented by Formula (1)

The toner includes toner particles and an organosilicon polymer covering the surface of the toner particles, the organosilicon polymer having a structure represented by Formula (1):

$$R—SiO_{3/2} \quad (1)$$

wherein R represents a hydrocarbon group having at least 1 and not more than 6 carbon atoms.

In the organosilicon polymer having a structure represented by Formula (1), one of four valences of Si atoms is bonded to R and the remaining three valences are bonded to O atoms. O atoms form a state in which two valences both are bonded to Si, that is, a siloxane bond (Si—O—Si).

In consideration of Si atoms and O atoms in the organosilicon polymer, since three O atoms are provided with respect to two Si atoms, it is represented by $—SiO_{3/2}$.

In addition, in the chart obtained by $^{29}$Si-NMR measurement of a tetrahydrofuran (THF) insoluble matter of toner particles, the proportion of the peak area ascribed to the structure of Formula (1) to the entire peak area of the organosilicon polymers is preferably 20% or more. Although a detailed measurement method will be described below, this approximates the case in which a substructure represented by $R—SiO_{3/2}$ has a proportion of 20% or more in the organosilicon polymer contained in toner particles.

As described above, among four valences of Si atoms, three valences are bonded to oxygen atoms, and these oxygen atoms are bonded to other Si atoms, which represents a structure of $—SiO_{3/2}$. If one oxygen atom among them is of a silanol group, the structure of the organosilicon polymer is represented by $R—SiO_{2/2}—OH$. In addition, when two oxygen atoms are of a silanol group, its structure is $R—SiO_{1/2}(—OH)_2$. Comparing these structures, a structure in which a larger number of oxygen atoms form a cross-linked structure together with Si atoms is closer to a silica structure represented by $SiO_2$. Therefore, when the number of frameworks of $—SiO_{3/2}$ increases, since it is possible to lower a surface free energy of the surface of toner particles, excellent environmental stability and anti-member contamination effects are obtained.

In addition, due to durability of the structure represented by Formula (1) and hydrophobicity and charging performance of R in Formula (1), bleeding of a low-molecular-weight (Mw of 1000 or less) resin and a low glass transition temperature (Tg was 40° C. or lower) resin which are present further inside than the surface layer and easily outmigrated is reduced. In some cases, bleeding of the release agent is also reduced.

It is possible to control the proportion of the peak area of the structure represented by Formula (1) according to the type and amount of the organosilicon compound used to form the organosilicon polymer and also the reaction temperature, the reaction time, the reaction solvent and pH for hydrolysis, addition polymerization and condensation polymerization when the organosilicon polymer is formed.

In the structure represented by Formula (1), R represents a hydrocarbon group having at least 1 and not more than 6 carbon atoms. Thereby, a charge amount is easily stabilized. In particular, an aliphatic hydrocarbon group or phenyl group having at least 1 and not more than 6 carbon atoms, which has excellent environmental stability, is preferable.

In the embodiment of the present invention, R is more preferably an aliphatic hydrocarbon group having at least 1 and not more than 3 carbon atoms because charging performance and fogging prevention are further improved. When charging performance is favorable, since transferability is favorable and an amount of the residual transfer toner is small, contamination of the drum, the charging member and the transfer member is reduced.

Preferable examples of an aliphatic hydrocarbon group having at least 1 and not more than 3 carbon atoms include a methyl group, an ethyl group, a propyl group, and a vinyl group. In consideration of environmental stability and storage stability, R is more preferably a methyl group.

Regarding an organosilicon polymer production example, a sol-gel method is preferable. The sol-gel method is a method in which a liquid raw material is used as a starting material and subjected to hydrolysis and condensation polymerization and gelled from a sol state, and is used as a method of synthesizing glass, ceramics, organic-inorganic hybrids, and nanocomposites. When this production method is used, it is possible to produce functional materials with various shapes such as the surface layer, fibers, bulk bodies, and fine particles at a low temperature from a liquid phase.

Specifically, the organosilicon polymer present on the surface layer of toner particles is preferably generated according to hydrolysis and condensation polymerization of a silicon compound represented by an alkoxysilane.

When the surface layer containing the organosilicon polymer is provided on toner particles, it is possible to obtain a toner having improved environmental stability, and in which reduction in toner performance during long term use is unlikely to occur, and having excellent storage stability.

In addition, the sol-gel method begins with a liquid, the liquid is gelled to form a material, and thus various micro structures and shapes can be formed. In particular, when toner particles are produced in the aqueous medium, they are easily precipitated on the surface of toner particles due to hydrophilicity of a hydrophilic group such as a silanol group of the organosilicon compound. The micro structure and shape can be adjusted according to the reaction temperature, the reaction time, the reaction solvent, and pH and the type and amount of the organometallic compound and the like.

The organosilicon polymer is preferably a condensation polymerization product of an organosilicon compound having a structure represented by the following Formula (Z).

[Chem. 1]

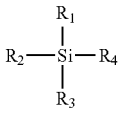

(Z)

(in Formula (Z), $R_1$ represents a hydrocarbon group having at least 1 and not more than 6 carbon atoms, and $R_2$, $R_3$ and $R_4$ each independently represent a halogen atom, a hydroxy group, an acetoxy group, or an alkoxy group)

According to a hydrocarbon group (preferably an alkyl group) for $R_1$, it is possible to improve hydrophobicity and it is possible to obtain toner particles having excellent environmental stability. In addition, regarding a hydrocarbon group, an aryl group which is an aromatic hydrocarbon group, for example, a phenyl group, can be used. When hydrophobicity of $R_1$ is large, a charge amount variation tends to increase in various environments. Therefore, in consideration of environmental stability, $R_1$ is preferably an aliphatic hydrocarbon group having at least 1 and not more than 3 carbon atoms and more preferably a methyl group.

$R_2$, $R_3$ and $R_4$ each independently represent a halogen atom, a hydroxy group, an acetoxy group, or an alkoxy group (hereinafter referred to as a reactive group). These reactive groups are subjected to hydrolysis, addition polymerization, and condensation polymerization to form a cross-linked structure, and a toner having excellent anti-member contamination and development durability can be obtained. In consideration of gentle hydrolyzability at room temperature, precipitation of toner particles on the surface, and coatability, an alkoxy group having at least 1 and not more than 3 carbon atoms is preferable, and a methoxy group or an ethoxy group is more preferable. In addition, it is possible to control hydrolysis, addition polymerization and condensation polymerization for $R_2$, $R_3$ and $R_4$ according to the reaction temperature, the reaction time, the reaction solvent and pH.

In order to obtain an organosilicon polymer used in the embodiment of the present invention, an organosilicon compound (hereinafter referred to as a trifunctional silane) having three reactive groups ($R_2$, $R_3$ and $R_4$) in one molecule except for $R_1$ in Formula (Z) shown above may be used alone or a plurality of types thereof may be used in combination.

Examples of Formula (Z) include the following.

Trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane.

Trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane.

Trifunctional phenylsilanes such as phenyltrimethoxysilane, phenyltriethoxysilane, phenyltrichlorosilane, phenyltriacetoxysilane, and phenyltrihydroxysilane.

In addition, as long as the effects of the present invention are not impaired, an organosilicon polymer obtained using the following compound together with an organosilicon compound having a structure represented by Formula (Z) may be used. An organosilicon compound having four reactive groups in one molecule (tetrafunctional silane), an organosilicon compound having two reactive groups in one molecule (bifunctional silane), or an organosilicon compound having one reactive group (monofunctional silane). Examples thereof include the following.

Trifunctional vinyl silanes such as dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl) aminopropyltriethoxysilane, vinyltriisocyanatesilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

In addition, the content of the organosilicon polymers in the toner particles is preferably at least 0.5 mass % and not more than 10.5 mass %.

When the content of the organosilicon polymer is 0.5 mass % or more, it is possible to further reduce a surface free energy of the surface layer, it is possible to improve flowability, and it is possible to reduce the occurrence of member contamination and fogging. When the content is 10.5 mass % or less, it is possible to make it difficult for charge up to occur. The content of the organosilicon polymer can be controlled according to the type and amount of the organosilicon compound used to form the organosilicon polymer, the toner particle production method, the reaction temperature, the reaction time, the reaction solvent and pH when the organosilicon polymer is formed.

The surface layer and the toner particles are preferably in contact with each other with no gap. Thereby, the occurrence of bleeding due to a resin component, a release agent, or the like further inside than the surface layer of toner particles is reduced, and it is possible to obtain a toner having excellent storage stability, environmental stability, and development durability. In addition to the above organosilicon polymer, a resin such as a styrene-acrylic copolymer resin, a polyester resin, and a urethane resin, various additives, and the like may be incorporated into the surface layer.

The above suspension polymerization method will be described in more detail.

Preferable examples of polymerizable monomers include the following vinyl polymerizable monomers.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butylacrylate, tert-butylacrylate, n-amylacrylate, n-hexylacrylate, 2-ethylhexylacrylate, n-octylacrylate, n-nonylacrylate, cyclohexylacrylate, benzylacrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; vinyl esters such as vinyl acetate, vinyl propionate, vinyl benzoate, vinyl butyrate, vinyl benzoate, and vinyl formate; vinyl ethers such as vinyl methyl ether, vinyl ethyl ether, and vinyl isobutyl ether; and vinyl methyl ketone, vinyl hexyl ketone, and vinyl isopropyl ketone.

Regarding a dispersion stabilizer of the inorganic compound with low water solubility, those including any of magnesium, calcium, barium, zinc, aluminum, and phosphorus are preferably used. More preferably, it is desirable to include any of magnesium, calcium, aluminum, and phosphorus. Specific examples include the following.

Magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatide. An organic compound, for example, a polyvinyl alcohol, gelatin, a sodium salt of methylcellulose, methylhydroxypropylcellulose, ethylcellulose, or carboxymethylcellulose, or starch may be used together with the dispersion stabilizer. At least 0.01 parts by mass and not more than 2.00 parts by mass of such a dispersion stabilizer with respect to 100 parts by mass of the polymerizable monomer is preferably used.

In addition, in order to refine such a dispersion stabilizer, at least 0.001 parts by mass and not more than 0.1 parts by mass of a surfactant may be used together with respect to 100 parts by mass of the polymerizable monomer. Specifically, commercially available nonionic, anionic, and cationic surfactants can be used. For example, sodium dodecyl sulfate, sodium tetradecyl sulfate, sodium pentadecyl sulfate, sodium octyl sulfate, sodium oleate, sodium laurate, potassium stearate, or calcium oleate is preferably used.

Regarding the polymerization initiator used in the suspension polymerization method, an oil-soluble initiator is generally used. Examples include the following.

Azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butylperoxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

Regarding the polymerization initiator, as necessary, a water soluble initiator may be used together, and examples thereof include the following.

Ammonium persulfate, potassium persulfate, 2,2'-azobis(N,N'-dimethyleneisobutyroamidine)hydrochloride, 2,2'-azobis(2-aminodinopropane)hydrochloride, azobis(isobutylamidine)hydrochloride, 2,2'-azobisisobutyronitrile sodium sulfonate, ferrous sulfate or hydrogen peroxide.

These polymerization initiators can be used alone or a plurality of types thereof can be used in combination. In order to control the degree of polymerization of the polymerizable monomer, a chain transfer agent, a polymerization inhibitor, and the like can be additionally added and then used.

Here, when the surface layer containing organosilicon polymers is formed, if toner particles were formed in the aqueous medium, while performing a polymerizing step in the aqueous medium, a hydrolysis solution of the organosilicon compound can be added to form the surface layer as described above. The dispersion solution of toner particles after polymerization is used as a core particle dispersion solution, and the hydrolysis solution of the organosilicon compound may be added to form the surface layer. In addition, in cases other than the aqueous medium such as a kneading pulverization method, the obtained toner particles are dispersed in an aqueous medium and used as a core particle dispersion solution, and the hydrolysis solution of the organosilicon compound can be added to form the surface layer as described above.

Method of Preparing THF Insoluble Matter of Toner Particles for NMR Measurement

A tetrahydrofuran (THF) insoluble matter of toner particles was prepared as follows.

10.0 g of toner particles were weighed out and put into a cylindrical filter paper (No. 86R commercially available from Toyo Roshi Kaisha, Ltd.) and caused to pass through a Soxhlet extractor. 200 mL of THF was used as a solvent, extraction was performed for 20 hours, the residue obtained by vacuum-drying the filtrate in the cylindrical filter paper at 40° C. for several hours was set as a THF insoluble matter of toner particles for NMR measurement.

Here, when the surface of toner particles was treated with an external additive or the like, the external additive was removed by the following method to obtain toner particles.

160 g of sucrose (commercially available from Kishida Chemical Co., Ltd.) was added to 100 mL of deionized water, and dissolved in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. According to this operation, toner particles and the detached external additive were separated. It was visually confirmed that the toner and the aqueous solution were sufficiently separated, and the toner separated in the top layer was collected using a spatula or the like. The collected toner was filtered in a filtration machine under a reduced pressure, and drying was then performed in a dryer for 1 hour or longer, and thereby toner particles were obtained. This operation was performed a plurality of times and a required amount was secured.

Method of Confirming Structure Represented by Formula (1)

In order to confirm the structure represented by Formula (1) in the organosilicon polymer contained in toner particles, the following method was used.

The hydrocarbon group represented by R in Formula (1) was confirmed according to 13C-NMR.

$^{13}$C-NMR (Solid) Measurement Conditions

Device: JNM-ECX500II commercially available from JEOLRESONANCE

Sample tube: 3.2 mmφ

Sample: 150 mg of tetrahydrofuran insoluble matter of toner particles for NMR measurement Measurement temperature: room temperature Pulse mode: CP/MAS Measurement nuclear frequency: 123.25 MHz ($^{13}$C)

Reference substance: adamantine (external standard: 29.5 ppm)

Sample rotational speed: 20 kHz

Contact time: 2 ms

Delay time: 2 s

Cumulative number: 1,024

In this method, a hydrocarbon group represented by R in Formula (1) was confirmed according to the presence or absence of a signal caused by a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$) or a phenyl group (Si—$C_6H_5$—) bonded to a silicon atom.

Method of Calculating Proportion of Peak Area Ascribed to Structure of Formula (1) in Organosilicon Polymer Contained in Toner Particles $^{29}$Si-NMR (solid) measurement of a THF insoluble matter of toner particles was performed under the following measurement conditions.

$^{29}$Si-NMR (Solid) Measurement Conditions

Device: JNM-ECX500II commercially available from JEOLRESONANCE

Sample tube: 3.2 mmφ

Sample: 150 mg of tetrahydrofuran insoluble matter of toner particles for NMR measurement Measurement temperature: room temperature Pulse mode: CP/MAS Measurement nuclear frequency: 97.38 MHz ($^{29}$Si)

Reference substance: DSS (external standard: 1.534 ppm)

Sample rotational speed: 10 kHz

Contact time: 10 ms

Delay time: 2 s

Cumulative number: 2000 to 8000

After the measurement, in a plurality of silane components having different substituents and linking groups in the tetrahydrofuran insoluble matter of toner particles, peaks were separated into the following X1 structure, X2 structure, X3 structure, and X4 structure according to curve fitting, and respective peak areas were calculated.

$$X1\ \text{structure}:(Ri)(Rj)(Rk)SiO_{1/2} \quad (2)$$

$$X2\ \text{structure}:(Rg)(Rh)Si(O_{1/2})_2 \quad (3)$$

$$X3\ \text{structure}:RmSi(Or_{1/2})_3 \quad (4)$$

$$X4\ \text{structure}:Si(O_{1/2})_4 \quad (5)$$

[Chem. 2]

X1 Structure:

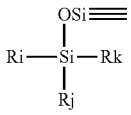

(2)

X2 Structure:

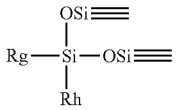

(3)

X3 Structure:

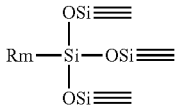

(4)

X4 Structure:

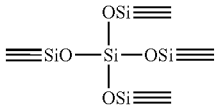

(5)

(In Formulae (2), (3) and (4), Ri, Rj, Rk, Rg, Rh, and Rm represent an organic group such as a hydrocarbon group having 1 to 6 carbon atoms, a halogen atom, a hydroxy group, an acetoxy group or an alkoxy group, which is bonded to a silicon atom)

In the embodiment of the present invention, in the chart obtained by $^{29}$Si-NMR measurement of a THF insoluble matter of toner particles, the proportion of the peak area ascribed to the structure of Formula (1) with respect to the entire peak area of the organosilicon polymer was preferably 20% or more.

Here, when it is necessary to confirm the structure represented by Formula (1) in more detail, the structure may be identified according to $^{1}$H-NMR measurement results together with the above $^{13}$C-NMR and $^{29}$Si-NMR measurement results.

Method of Measuring Proportion of Surface Layer Containing Organosilicon Polymer, Which Has Thickness of 2.5 Nm or Less, Measured in Observation of Cross Section of Toner Particle Using Transmission Electron Microscope (TEM)

In the embodiment of the present invention, the cross section of toner particles was observed according to the following method.

Regarding a specific method of observing the cross section of toner particles, toner particles were sufficiently dispersed in a curable epoxy resin at normal temperature, and then cured for 2 days in an atmosphere of 40° C. A flaky sample was cut out from the obtained cured product using a microtome having diamond teeth. This sample was enlarged at a magnification of 10000 to 100000 under a transmission electron microscope (JEM-2800 commercially available from JEOL) (TEM), and the cross section of toner particles was observed.

Confirmation can be made using the fact that the contrast was brighter when the atomic weight was larger using a difference in atomic weights between the binder resin and the surface layer material. In order to impart contrast between materials, a ruthenium tetroxide staining method or an osmium tetroxide staining method was used.

Regarding particles used for the measurement, an equivalent circle diameter Dtem was obtained from the cross section of toner particles obtained through the above TEM photomicrograph, and its value was within in the width of ±10% of the weight-average particle diameter D4 of the toner particles.

As described above, using JEM-2800 (commercially available from JEOL), a dark field image of the cross section of toner particles was acquired at an acceleration voltage of 200 kV. Next, using EELS detector GIFQuantam (commercially available from Gatan), a mapping image was acquired according to the ThreeWindow method, and thereby the surface layer was confirmed.

Figure 5:
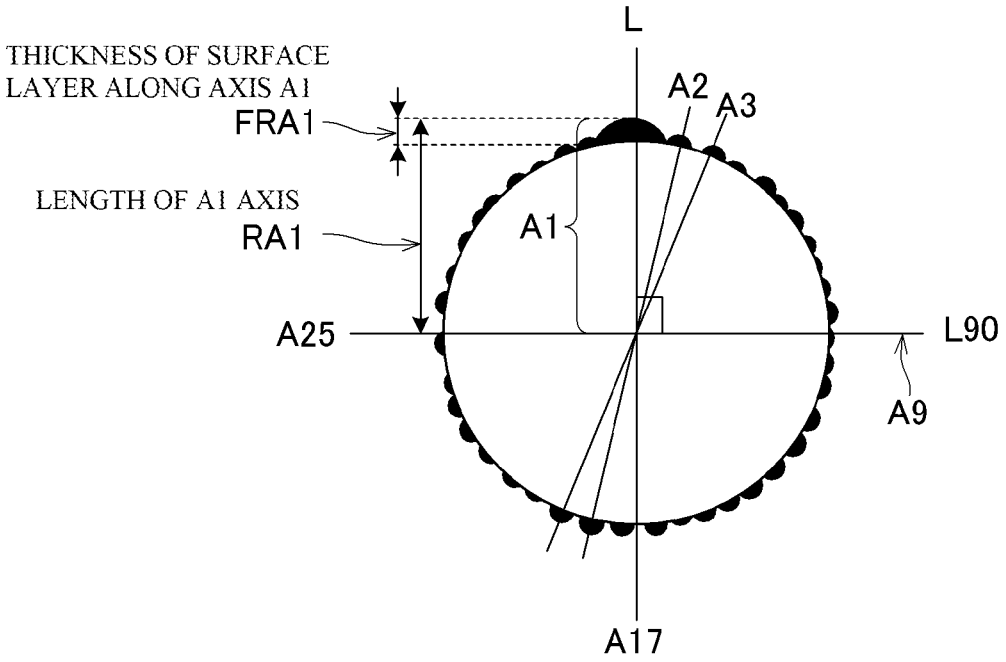
FIG. 5 is a conceptual view of a surface layer thickness of a surface layer containing an organosilicon compound according to Embodiment 3 of the present invention.

Next, regarding one toner particle in which the equivalent circle diameter Dtem was within in the width of ±10% of the weight-average particle diameter D4 of toner particles, based on the intersection between the long axis L of the cross section of the toner particle and the axis L90 that passes through the center of the long axis L and is perpendicular thereto, the cross section of the toner particle was uniformly divided into 16 segments (refer to FIG. 5). Next, division axes from the center toward the surface layer of the toner particle were set as An (n=1 to 32), the length of the division axis was set as RAn, and the thickness of the surface layer was set as FRAn.

Then, a proportion of the number of division axes in which the thickness of the surface layer containing the organosilicon polymer on each of the 32 division axes was 2.5 nm or less was obtained. For averaging, 10 toner particles were measured, and an average value per one toner particle was calculated.

Equivalent Circle Diameter (Dtem) Obtained from Cross Section of Toner Particle Obtained in Transmission Electron Microscope (TEM) Image The equivalent circle diameter (Dtem) obtained from the cross section of the toner particle obtained in a TEM image was obtained according to the following method. First, for one toner particle, the equivalent circle diameter Dtem obtained from the cross section of the toner particle obtained in the TEM image was obtained according to the following formula.

[Equivalent circle diameter (Dtem) obtained from the cross section of the toner particle obtained in the TEM image]=$(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$ The equivalent circle diameters of 10 toner particles were obtained, and an average value per one particle was calculated to obtain the equivalent circle diameter (Dtem) obtained from the cross section of the toner particle.

Proportion of Surface Layer Containing Organosilicon Polymer, Which as Thickness of 2.5 Nm or Less

[Proportion of the surface layer containing an organosilicon polymer, which has a thickness (FRAn) of 2.5 nm or less]=[{the number of division axes in which the thickness (FRAn) of the surface layer containing an organosilicon polymer is 2.5 nm or less}/32]×100

This calculation was performed for 10 toner particles, an average value of proportions in which the thickness (FRAn) of the obtained 10 surface layers was 2.5 nm or less was obtained as a proportion of the surface layer of the toner particle having a thickness (FRAn) of 2.5 nm or less.

Method of Measuring Adhesion Rate of Organosilicon Polymers 160 g of sucrose (commercially available from Kishida Chemical Co., Ltd.) was added to 100 mL of deionized water, and dissolved in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. It was visually confirmed that the toner and the aqueous solution were sufficiently separated, and the toner separated in the top layer was collected using a spatula or the like. The aqueous solution containing the collected toner was filtered in a filtration machine under a reduced pressure and drying was then performed in a dryer for 1 hour or longer. The dried product was deagglomerated using a spatula, and an amount of silicon was measured through X-ray fluorescence. An adhesion rate (%) was calculated based on the ratio of amounts of elements to be measured between the toner after washing and the toner before washing.

The X-ray fluorescence of elements was measured according to JIS K 0119-1969, and details are as follows.

Regarding a measuring device, a wavelength dispersive X-ray fluorescence analyzing device "Axios" (commercially available from PANalytical), and bundled dedicated software "SuperQ ver. 4.0F" (commercially available from PANalytical) for measurement condition setting and measurement data analysis were used. Here, Rh was used as an X-ray tube anode, the measurement atmosphere was a vacuum, the measurement diameter (collimator mask diameter) was 10 mm, and the measurement time was 10 seconds. In addition, when a light element was measured, the X-ray fluorescence was detected by a proportional counter (PC), and when a heavy element was measured, the X-ray fluorescence was detected by a scintillation counter (SC).

Regarding a measurement sample, pellets obtained by putting about 1 g of the toner after washing with water and the initial toner into an exclusive aluminum ring for pressing with a diameter of 10 mm and flattening it, and performing pressing at 20 MPa for 60 seconds using a tablet molding compressor "BRE-32" (commercially available from Maekawa Testing Machine MFG. Co., Ltd.), and performing molding to a thickness of about 2 mm were used.

Measurement was performed under the above conditions, an element was identified based on the obtained X-ray peak position, and its concentration was calculated from a counting rate (unit: cps) which was the number of X-ray photons per unit time.

In a quantitative method in the toner, for example, regarding an amount of silicon, for example, 0.5 parts by mass of silica ($SiO_2$) fine powder was added with respect to 100 parts by mass of toner particles, and the mixture was sufficiently mixed using a coffee mill. In the same manner, 2.0 parts by mass and 5.0 parts by mass of silica fine powder were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represented the obtained X-ray counting rate and the horizontal axis represented an amount of $SiO_2$ added in each calibration curve sample was obtained.

Next, the toner to be analyzed was formed into pellets as described above using a tablet molding compressor, and the counting rate of Si-Kα rays was measured. Then, the content of organosilicon polymers in the toner was obtained from the above calibration curve. The ratio of the amount of elements of the toner after washing to the amount of elements of the toner before washing calculated by the above method was obtained and used as an adhesion rate (%).

Production Example of Toner

Embodiment 3 will be specifically described below, and the present invention is not limited to these examples, and unless otherwise specified, "parts" of materials in examples and comparative examples are all based on the mass.

Step of Preparing Aqueous Medium 1

14.0 parts of sodium phosphate (12 hydrate, commercially available from Rasa Industries, Ltd.) was put into 1000.0 parts of deionized water in a reaction container and the mixture was kept at 65° C. for 1.0 hours while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added together to prepare an aqueous medium containing a dispersion stabilizer. In addition, 10 mass % hydrochloric acid was added to the aqueous medium, pH was adjusted to 5.0, and thereby an aqueous medium 1 was obtained.

Step of Hydrolyzing Organosilicon Compound for Surface Layer 60.0 parts of deionized water was weighed out in a reaction container including a stirrer and a thermometer, and pH was adjusted to 3.0 using 10 mass % of hydrochloric acid. The result was heated with stirring and the temperature was set to 70° C. Then, 40.0 parts of methyltriethoxysilane which was an organosilicon compound for a surface layer was added and the mixture was stirred for 2 hours or longer and hydrolyzed. At the end point of hydrolysis, it was visually confirmed that oil and water were not separated but formed one layer, cooling was performed, and a hydrolysis solution of an organosilicon compound for a surface layer was obtained.

Step of Preparing Polymerizable Monomer Composition

| | |
|---|---|
| Styrene | 60.0 parts |
| C.I. Pigment blue15:3 | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene | 20.0 parts |
| n-butyl acrylate | 20.0 parts |
| Cross-linking agent (divinylbenzene) | 0.3 parts |
| Saturated polyester resin (poly-condensate of propylene oxide modified bisphenol A (2 mol adduct) and terephthalic acid (molar ratio 10:12), glass transition temperature Tg = 68° C., weight-average molecular weight Mw = 10000, and molecular weight distribution Mw/Mn = 5.12) | 5.0 parts |
| Fischer-Tropsch wax (melting point 78° C.) | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

Granulating Step

The temperature of the aqueous medium 1 was set to 70° C., and while maintaining the rotational speed of the T. K. Homomixer at 12000 rpm, the polymerizable monomer composition was added to the aqueous medium 1, and 9.0 parts of t-butyl peroxypivalate as a polymerization initiator was added. Granulation was performed for 10 minutes while maintaining 12000 rpm in the stirring device without change.

Polymerizing Step

After the granulating step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours, and thereby core particles were obtained. When the temperature of the slurry was cooled at 55° C. and pH was measured, pH was 5.0. While stirring continued at 55° C., 20.0 parts of a hydrolysis solution of an organosilicon compound for a surface layer was added and formation of the surface layer of the toner started. After maintaining for 30 minutes without change, the slurry was adjusted to pH-9.0 for completing condensation using a sodium hydroxide aqueous solution, and was additionally left for 300 minutes, and the surface layer was formed.

Washing and Drying Step

After the polymerizing step was completed, the toner particle slurry was cooled, and hydrochloric acid was added to the toner particle slurry so that pH was adjusted to 1.5 or less, the mixture was stirred and left for 1 hour, and solid-liquid separation was then performed using a pressure filter, and a toner particle cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner particle cake.

The obtained toner particle cake was dried using an airflow dryer flash jet dryer (commercially available from Seishin Enterprise Co., Ltd.), and additionally, fine powder was cut using a multi-grade classifier using a Coanda effect to obtain toner particles. Regarding drying conditions, the blowing temperature was set to 90° C., the dryer outlet temperature was set to 40° C., and the toner particle cake supply speed was adjusted to a speed at which the outlet temperature did not deviate from 40° C. according to the content of water of the toner particle cake.

Silicon mapping was performed in observation of the cross section of toner particles under a TEM, and it was confirmed that silicon atoms were present on the surface layer, and the proportion of the number of division axes in which the thickness of the surface layer of toner particles containing organosilicon polymers was 2.5 nm or less was 20.0% or less. In all of the toners of the following examples, it was confirmed that, in the surface layer containing organosilicon polymers, silicon atoms were present on the surface layer according to the same silicon mapping, and the proportion of the number of division axes in which the thickness of the surface layer was 2.5 nm or less was 20.0% or less. In this example, the obtained toner particles were directly used as a toner c without external addition of any of inorganic silicon fine particles.

The adhesion rate of the organosilicon polymer having a structure represented by Formula (1) covering the surface of toner particles on the surface of the toner particles was preferably at least 30% and not more than 100%. In addition, the adhesion rate of the organosilicon polymer having a structure represented by Formula (1) covering the surface of the toner particles in the toner of the example used in the present embodiment was 30% or more. This is because the attachment force between toners increased and charging performance varied when the area of the surface layer part in which there were no organosilicon polymers increased.

In Embodiment 3, a toner in which inorganic silicon fine particles or fine particles containing organosilicon polymers were not externally added and the surface of toner particles was covered with organosilicon polymers was used. The organosilicon polymers were less likely to be separated from the toner (the adhesion rate was higher) compared with the case in which a toner in which inorganic silicon fine particles or fine particles containing organosilicon polymers were externally added was used. Therefore, it was possible to efficiently supply only the metal soap to grooves of the photosensitive member and it was possible to further maintain an image smearing reduction effect of the metal soap.

Example

In Embodiment 3, toners c to e produced using the above toner production method so that the adhesion rates of organosilicon polymers were different were prepared.

The adhesion rate varied depending on toner production conditions. In the present embodiment, toners having different adhesion rates were produced by changing conditions in which a hydrolysis solution was added in the polymerizing step and a retention time after addition. Here, pH of the slurry was adjusted using hydrochloric acid and a sodium hydroxide aqueous solution. Table 8 shows conditions for producing toners having different adhesion rates.

In addition, in the toners c to e produced according to the above method, in the same manner as in Embodiment 1, zinc stearate was treated as the metal soap so that the content in the toner was 0.20 mass %.

TABLE 8

| | Conditions when hydrolysis solution is added | | | Conditions after hydrolysis solution is added | |
|---|---|---|---|---|---|
| | Slurry pH | Slurry temperature (°C.) | The number of parts of hydrolysis solution added (parts) | Retention time until pH for completing condensation is adjusted (minutes) | Adhesion rate (%) |
| Toner c | 5.0 | 55 | 20.0 | 30 | 97 |
| Toner d | 7.0 | 65 | 20.0 | 3 | 95 |
| Toner e | 9.0 | 70 | 20.0 | 0 | 90 |

Combinations of toners and photosensitive members shown in Table 9 were prepared.

TABLE 9

| | Toner | Photosensitive member |
|---|---|---|
| Example 1 | Toner a | Photosensitive member a |
| Example 4 | Toner b | Photosensitive member a |
| Example 5 | Toner c | Photosensitive member a |
| Example 6 | Toner d | Photosensitive member a |
| Example 7 | Toner e | Photosensitive member a |

Experiment

In order to check the occurrence of image smearing in Examples 1 and 4 to 7, 10000 sheets per day were continuously passed at a 1% print percentage and then left in the machine for a day, and then the presence or absence of image smearing after being left was compared.

In the image smearing test, one halftone image was printed and evaluated. Evaluation was as follows.

O: Not occurred (There were no blank dots due to latent image rounding or contour blurring at the boundary of the image in the entire image)

x: Occurred (Blank dots due to latent image rounding or contour blurring at the boundary of the image occurred in a part of the image or the entire image)

Paper passing and testing were performed in an environment at 32° C. and 80% RH. The total number of sheets that passed was 100000 sheets.

In addition, a photosensitive member surface speed was 296 mm/s, a developing roller surface speed was 425 mm/s, a photosensitive member surface potential was −500 V, a developing roller applied voltage was −350 V, a supply roller voltage was −450 V, and a regulating member voltage was −450 V.

Experiment results are shown in Table 10.

TABLE 10

| | The number of sheets that passed (*1000) | | | | | | | | | |
|---|---|---|---|---|---|---|---|---|---|---|
| | 10 | 20 | 30 | 40 | 50 | 60 | 70 | 80 | 90 | 100 |
| Example 1 | ○ | ○ | ○ | ○ | ○ | × | × | × | × | × |
| Example 4 | ○ | ○ | ○ | ○ | ○ | ○ | ○ | ○ | × | × |
| Example 5 | ○ | ○ | ○ | ○ | ○ | ○ | ○ | ○ | ○ | ○ |
| Example 6 | ○ | ○ | ○ | ○ | ○ | ○ | ○ | ○ | ○ | ○ |
| Example 7 | ○ | ○ | ○ | ○ | ○ | ○ | ○ | ○ | ○ | ○ |

○: Not occured
×: Occurred

As shown in Table 10, in Examples 5 to 7 using the toner in which the surface of toner particles was covered with organosilicon polymers, there was no image smearing throughout the experiment. On the other hand, in Example 1 using the toner in which inorganic silicon fine particles were provided on the surface of toner particles, no image smearing occurred with up to 50000 sheets, but image smearing occurred with 60000 sheets. In addition, in Example 4 using the toner in which fine particles containing organosilicon polymers were provided on the surface of toner particles, no image smearing occurred with up to 80000 sheets, but image smearing occurred with 90000 sheets.

This can be considered as follows. When the adhesion rate of inorganic silicon fine particles and the adhesion rate of organosilicon polymer were low, they were easily released from the toner. Since the released inorganic silicon fine particles and the released organosilicon polymers were also supplied to the grooves on the surface of the photosensitive member in the same manner as the metal soap, despite the fact that the metal soap was intended to be supplied to the groove, the inorganic silicon fine particles and the organosilicon polymers were filled into the grooves. It was thought that, when inorganic silicon fine particles or organosilicon polymers entered grooves of the photosensitive member, an amount of the metal soap supplied to the grooves was reduced and an image smearing reduction effect of the metal soap was weakened.

In order to maintain the image smearing reduction effect of the metal soap, the adhesion rate was preferably 90% or more, 95% or more, or 97% or more as in Examples 5 to 7.

However, when inorganic silicon fine particles or fine particles containing organosilicon polymers were present on the surface of the toner, it was difficult to obtain an adhesion rate of higher than 90% according to the above method. On the other hand, in the toner in which the surface of toner particles was covered with organosilicon polymers, it was not possible to achieve the adhesion rate. In addition, in a preferable aspect, the toner includes no inorganic silicon fine particles as an external additive.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213917, filed on Nov. 14, 2018, and, Japanese Patent Application No. 2018-247010, filed on Dec. 28, 2018, which are hereby incorporated by reference herein in their entirety.

What is claimed is:

1. A process cartridge for use in an image forming apparatus, comprising:

an image bearing member configured to be rotatable and have a circumferential surface on which a latent image is formed;

a developing unit storing a developing agent, the developing unit being configured to supply the developing agent to the image bearing member in order to develop the latent image on the image bearing member; and a cleaning member configured to contact the circumferential surface of the image bearing member and clean the circumferential surface, wherein the developing agent stored in the developing unit contains a toner including toner particles and a metal soap, the image bearing member includes a plurality of grooves formed on the circumferential surface so as to extend in a circumferential direction of the circumferential surface and to be arranged side by side in a rotation axis direction, the plurality of grooves and portions between the grooves forming concave-convex portions on the circumferential surface, the circumferential surface of the image bearing member has a ten-point average surface roughness Rz that is less than an average particle diameter of the metal soap so that the metal soap remains on the circumferential surface of the image bearing member, the average particle diameter of the metal soap is at least 0.15 μm and not more than 2.00 μm so that the metal soap is supplied from the toner to the grooves on the surface of the image bearing member, and the ten-point average surface roughness Rz is in a range of $0.10 \leq Rz \leq 0.53$ μm and an average interval Sm between concave-convex portions on the circumferential surface of $0 < Sm \leq 70.0$ μm so as to increase an amount of time that the metal soap remains on the circumferential surface, thereby reducing an occurrence of image smearing.

2. The process cartridge according to claim 1, wherein the toner includes inorganic silicon fine particles present on the surface of the toner particles.

3. The process cartridge according to claim 1, wherein the toner particles include fine particles present on the surface of the toner particles, the fine particles containing an organosilicon polymer having a structure represented by the following Formula (1):

$$R—SiO_{3/2} \quad (1)$$

wherein R represents a hydrocarbon group having at least 1 and not more than 6 carbon atoms.

4. The process cartridge according to claim 3, wherein when the ratio of the amount of silicon in the toner particles after washing with aqueous solution of neutral detergent to the amount of silicon in the toner particles before washing with the aqueous solution of neutral detergent is defined as an adhesion ratio, the adhesion ratio of the fine particles to the surface of the toner particles is at least 30% and not more than 90%.

5. The process cartridge according to claim 3, wherein the toner includes no inorganic silicon fine particles as an external additive.

6. The process cartridge according to claim 1, wherein the toner particles include an organosilicon polymer covering the surface of the toner particles, the organosilicon polymer having a structure represented by the following Formula (1):

$$R—SiO_{3/2} \quad (1)$$

wherein R represents a hydrocarbon group having at least 1 and not more than 6 carbon atoms.

7. The process cartridge according to claim 6, wherein R represents an aliphatic hydrocarbon group having at least 1 and not more than 3 carbon atoms.

8. The process cartridge according to claim 6, wherein when the ratio of the amount of silicon in the toner particles after washing with aqueous solution of neutral detergent to the amount of silicon in the toner particles before washing with the aqueous solution of neutral detergent is defined as an adhesion ratio, the adhesion ratio of the organosilicon polymer on the surface of each of the toner particles is 90% or more.

9. The process cartridge according to claim 1, wherein the metal soap contains at least one metal selected from the group consisting of zinc, calcium, and magnesium.

10. The process cartridge according to claim 1, wherein the metal soap is zinc stearate, calcium stearate, or magnesium stearate.

11. The process cartridge according to claim 1, wherein the developing unit is a contact developing unit that performs developing by contacting a developing agent carrying member carrying the developing agent with the image bearing member.

12. The process cartridge according to claim 1, wherein the image bearing member includes a protective layer on the outermost layer.

13. The process cartridge according to claim 12, wherein the protective layer contains an acrylic resin.

14. The process cartridge according to claim 1, further comprising a frame body which rotatably supports the image bearing member and to which the cleaning member is fixed, wherein the cleaning member includes a plate-like elastic body and a plate-like support that supports the plate-like elastic body, the plate-like elastic body has one end that is fixed to the plate-like support and the other end as a free end that comes into contact with the circumferential surface, the plate-like support has one end that is fixed to the frame body and the other end as a free end to which the plate-like elastic body is fixed, and a direction that extends from the one end of the plate-like support to the other end of the plate-like elastic body is opposite to a rotation direction of the image bearing member at a portion where the other end is in contact with the circumferential surface.

15. The process cartridge according to claim 1, wherein in an orientation during use, the image bearing member rotates so that the circumferential surface moves in a downward direction at a portion where the cleaning member is in contact.

16. An image forming apparatus, comprising:

a device body; and the process cartridge according to claim 1 which is detachable from the device body.

17. A process cartridge for use in an image forming apparatus, comprising:

an image bearing member configured to be rotatable and have a circumferential surface on which a latent image is formed;

a developing unit storing a developing agent, the developing unit configured to supply the developing agent to the image bearing member in order to develop the latent image on the image bearing member; and a cleaning member configured to contact the circumferential surface of the image bearing member and clean the circumferential surface, wherein the developing agent stored in the developing unit contains a toner including toner particles and a metal soap, the image bearing member includes a plurality of grooves formed on the circumferential surface so as to extend in a circumferential direction of the circumferential surface and to be arranged side by side in a rotation axis direction, the plurality of grooves and portions between the grooves forming concave-convex portions on the circumferential surface, and the circumferential surface of the image bearing member has a ten-point average surface roughness Rz of $0<Rz\leq0.70$ μm and an average interval Sm between concave-convex portions on the circumferential surface of $0<Sm\leq70.0$ μm, and an average particle diameter of the metal soap is larger than the ten-point average surface roughness Rz, wherein the toner particles include an organosilicon polymer covering the surface of the toner particles, wherein when the ratio of the amount of silicon in the toner particles after washing with aqueous solution of neutral detergent to the amount of silicon in the toner particles before washing with the aqueous solution of neutral detergent is defined as an adhesion ratio, the adhesion ratio of the organosilicon polymer on the surface of each of the toner particles is 90% or more.

* * * * *